US011209770B2

(12) United States Patent
Okamoto et al.

(10) Patent No.: US 11,209,770 B2
(45) Date of Patent: Dec. 28, 2021

(54) FRAME BODY OF IMAGE FORMING APPARATUS AND IMAGE FORMING APPARATUS PROVIDED WITH THE FRAME BODY

(71) Applicant: SHARP KABUSHIKI KAISHA, Osaka (JP)

(72) Inventors: Shohtaroh Okamoto, Osaka (JP); Masafumi Sakamoto, Osaka (JP); Shinichi Takeda, Osaka (JP); Noriaki Taguchi, Osaka (JP); Hideaki Kadowaki, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/900,445

(22) Filed: Jun. 12, 2020

(65) Prior Publication Data

US 2020/0393788 A1 Dec. 17, 2020

(30) Foreign Application Priority Data

Jun. 14, 2019 (JP) ..... JP2019-111483
Jun. 14, 2019 (JP) ..... JP2019-111484
Jun. 14, 2019 (JP) ..... JP2019-111485

(51) Int. Cl.
*G03G 21/16* (2006.01)
*G03G 15/00* (2006.01)

(52) U.S. Cl.
CPC ..... *G03G 21/1619* (2013.01); *G03G 15/6529* (2013.01)

(58) Field of Classification Search
CPC ..... G03G 21/1619; G03G 15/6529; G03G 21/1647
See application file for complete search history.

(56) References Cited

U.S. PATENT DOCUMENTS

2011/0274463 A1 11/2011 Taguchi et al.
2014/0086658 A1* 3/2014 Shimizu ..... G03G 15/00 399/393
2016/0187838 A1* 6/2016 Onishi ..... G03G 21/1619 399/107

FOREIGN PATENT DOCUMENTS

JP 2010-026152 A 2/2010
JP 2011-237579 A 11/2011

* cited by examiner

*Primary Examiner* — Sandra Brase
(74) *Attorney, Agent, or Firm* — ScienBiziP, P.C.

(57) ABSTRACT

An image forming apparatus comprises a housing including a resin frame. The resin frame is divided in a sheet feeding direction to include a conveyance frame, a process frame and a fixation frame. Moreover, the image forming apparatus comprises a driving unit and a drive frame. The driving unit is attachably and detachably provided in the drive frame, and applies a rotational driving force to rotating bodies. The drive frame is positioned with respect to the conveyance frame or the process frame, supports the rotating bodies, and has an attaching portion for the driving unit. Moreover, the drive frame is attached to one surface of the resin frame.

29 Claims, 30 Drawing Sheets

FRAME BODY OF IMAGE FORMING APPARATUS AND IMAGE FORMING APPARATUS PROVIDED WITH THE FRAME BODY

CROSS REFERENCE OF RELATED APPLICATION

The disclosure of Japanese Patent Application Nos. 2019-111483, 2019-111484, 2019-111485 all filed on Jun. 14, 2019 are incorporated herein by reference.

BACKGROUND OF THE INVENTION

Field of the Invention

The present invention relates to a frame body of an image forming apparatus and an image forming apparatus provided with the frame body, and more specifically, relates to a frame body made of resin of an image forming apparatus and an image forming apparatus provided with the same.

Description of the Related Art

An example of a related art is disclosed in Japanese patent application laying-open No. 2010-026152 [G03G 15/00] laid-open on Feb. 4, 2010 (Literature 1). An image forming apparatus disclosed in Literature 1 comprises a main body casing that accommodates respective components, and includes a sheet metal frame having a support portion of a photoreceptor, a drum drive sheet metal frame supporting a driving unit that drives the photoreceptor and a resin frame. Moreover, in the image forming apparatus disclosed in Literature 1, the sheet metal frame is secured to one surface of the resin frame, and the drum drive sheet metal frame is secured to another surface of the resin frame.

However, in the image forming apparatus disclosed in Literature 1, since the sheet metal frame and the drum drive sheet metal frame are secured so as to sandwich the resin frame, an attaching work of the sheet metal frames to the resin frame becomes complicated. Therefore, there is a problem in terms of workability.

SUMMARY OF THE INVENTION

The present invention has been made in view of the above, and it is an object of the present invention to provide a frame body of an image forming apparatus and an image forming apparatus provided with the same, capable of improving workability when attaching a sheet metal member to a resin frame body.

A first embodiment is an image forming apparatus having a sheet feeding path, comprising: a first resin frame made of resin; a second resin frame made of resin; a rotating body; a driving unit; and a positioning portion. The second resin frame is provided in a downstream side in a sheet feeding direction compared with the first resin frame. At least one rotating body is attached to each of the first resin frame and the second resin frame. The driving unit includes a driving mechanism that applies a rotational driving force to the rotating bodies. The positioning portion has a support portion, and an attaching portion of the driving unit. The support portion is positioned with respect to one of the first resin frame and the second resin frame, and supports the rotating body attached to another of the first resin frame and the second resin frame. Moreover, the positioning portion is attached to a surface of one of the first resin frame and the second resin frame.

A second embodiment is the image forming apparatus according to the first embodiment, wherein the first positioning portion is provided attachably and detachably to the driving unit.

A third embodiment is the image forming apparatus according to the first embodiment or second embodiment, wherein the driving mechanism includes a first driving mechanism and a second driving mechanism. The first driving mechanism includes at least one drive source that rotationally drives a first type of rotating body out of the rotating bodies. The second driving mechanism includes a plurality of drive sources, and rotationally drives the first type of rotating body and a second type of rotating body out of the rotating bodies. The driving unit includes a first driving unit including the first driving mechanism, and a second driving unit including the first driving mechanism and the second driving mechanism. The positioning portion comprises selectively one of a first type positioning frame attached to the first driving unit and a second type positioning frame attached to the second driving unit.

A fourth embodiment is the image forming apparatus according to the third embodiment, wherein the driving unit includes a third driving mechanism. The third driving mechanism includes at least one drive source, and drives rotationally a third type rotating body out of the rotating bodies. The second driving unit includes a first support frame that supports the first driving mechanism and the third driving mechanism, and a second support frame that supports the second driving mechanism. The first support frame and the second support frame are positioned and secured to one of the first type positioning frame and the second type positioning frame in parallel with each other.

A fifth embodiment is the image forming apparatus according to the third embodiment, wherein the driving unit includes a third driving mechanism. The third driving mechanism includes at least one drive source, and drives rotationally a third type rotating body out of the rotating bodies. The first driving unit includes the third driving mechanism.

A sixth embodiment is the image forming apparatus according to the fourth embodiment, further comprising a positioning/securing portion that secures the first support frame and the second support frame into a predetermined positional relationship.

A seventh embodiment is the image forming apparatus according to the third embodiment, wherein the first driving mechanism includes a plurality of drive sources each of which drives rotationally the first type rotating body corresponding thereto.

An eighth embodiment is the image forming apparatus according to the third embodiment, wherein the first driving mechanism includes a feed driving mechanism that drives rotationally the rotating body arranged along the sheet feeding path out of the rotating bodies.

A ninth embodiment is the image forming apparatus according to the first embodiment, wherein the driving unit includes a securing portion for securing the driving unit to the first resin frame and the second resin frame.

A tenth embodiment is a frame body of an image forming apparatus that comprises a sheet feeding portion including a sheet stop roller that controls a feeding timing of a sheet and an image forming portion that forms an image on the sheet fed by the sheet feeding portion. The frame body is provided with a conveyance frame made of resin, a process frame made of resin, and a first positioning portion. The conveyance frame supports the sheet feeding portion. The process frame is attached to the conveyance frame in a downstream side in a sheet feeding direction, and supports the image forming portion. The first positioning portion positions the process frame with respect to the conveyance frame with a driving axis of the sheet stop roller as a reference.

An eleventh embodiment is the frame body according to the tenth embodiment, wherein the first positioning portion includes a first engaging portion and a second engaging portion. The first engaging portion is provided on the conveyance frame, and is formed with being centered by the driving axis of the sheet stop roller. The second engaging portion is provided on the process frame, and engages with the first engaging portion.

A twelfth embodiment is the frame body according to the eleventh embodiment, wherein the conveyance frame includes a bearing portion that bears the driving axis of the sheet stop roller, and the first engaging portion has a circular arc-shaped first engaging surface formed coaxially with the bearing portion, and the second engaging portion has a second engaging surface that engages with the first engaging surface.

A thirteenth embodiment is the frame body according to the tenth embodiment, wherein the image forming apparatus further comprises a fixing portion provided in a downstream side in the sheet feeding direction compared with the image forming portion to fix an image formed on the sheet with heating, and a discharge portion provided in a downstream side in sheet feeding direction compared with the fixing portion to discharge the sheet outside the apparatus. The frame body further comprises a fixation frame made of resin, and a second positioning portion. The fixation frame is attached to the conveyance frame in a downstream side in the sheet feeding direction, and supports the fixing portion and the discharge portion. The second positioning portion positions the fixation frame with respect to the conveyance frame.

A fourteenth embodiment is the frame body according to the thirteenth embodiment, wherein the conveyance frame, the process frame and the fixation frame are made of resins different from each other.

A fifteenth embodiment is the frame body according to the thirteenth embodiment, wherein the second positioning portion further comprises a metallic coupling member secured to the conveyance frame of the fixation frame for positioning the fixation frame with respect to the conveyance frame.

A sixteenth embodiment is the frame member according to the fifteenth embodiment, wherein the second positioning portion includes a second protruding portion provided on the conveyance frame, a third protruding portion provided on the fixation frame in a position away from the second protruding portion by a predetermined distance, a second fitting portion provided on the coupling member to be fit to the second protruding portion, and a third fitting portion provided on the coupling member to be fit to the third protruding portion.

A seventeenth embodiment is the frame body according to the fifteenth embodiment, wherein the image forming apparatus further comprises a sheet feeding portion and a first driving mechanism that applies a rotational driving force to the sheet feeding portion and the image forming portion. The coupling member is arranged in each of both outsides of the sheet feeding path that the sheet is fed, and one coupling member supports the first driving mechanism.

An eighteenth embodiment is the frame body according to the seventeenth embodiment, wherein the image forming apparatus further comprises a second driving mechanism that transmits a rotational driving force to the fixing portion and the discharge portion. The second driving mechanism is supported by the one coupling member.

A nineteenth embodiment is the frame body according to the seventeenth embodiment, further comprising a fastening portion for fastening the one coupling member and the conveyance frame with a predetermined securing tool.

A twentieth embodiment is the frame body according to the thirteenth embodiment, wherein the process frame includes a guide portion that guides the fixation frame to a predetermined position prior to the fixation frame is secured to the conveyance frame.

A twenty-first embodiment is the frame body according to the tenth embodiment, wherein the conveyance frame is formed with a sheet guide portion that guides the sheet.

A twenty-second embodiment is an image forming apparatus, comprising: a conveyance frame made of resin; a process frame made of resin; and a positioning portion. The conveyance frame supports a sheet feeding portion that feeds a sheet. The process frame accommodates an image forming portion that forms an image onto the sheet. The positioning portion positions the image forming portion with respect to the conveyance frame. Moreover, the positioning portion includes a positioning engaging portion that is engaged with the conveyance frame, and an attachment positioning portion that supports the image forming portion and defines an attaching position of the image forming portion.

A twenty-third embodiment is the image forming apparatus according to the twenty-second embodiment, wherein the first positioning portion includes a fitting protruding portion provided on the conveyance frame and a fitting hole formed on the portioning engaging portion to be fit with the fitting protruding portion.

A twenty-fourth embodiment is the image forming apparatus according to the twenty-second embodiment, wherein the sheet feeding portion includes a feed roller that feeds the sheet, and the conveyance frame includes a drive supporting member that supports a feed driving mechanism that applies a rotational drive force to the feed roller, and the positioning engaging portion is attached to the conveyance frame via the drive supporting member.

A twenty-fifth embodiment is the image forming apparatus according to the twenty-fourth embodiment, wherein the feed drive support member includes a fitting hole to be fit with the fitting protruding portion provided on the conveyance frame.

A twenty-sixth embodiment is the image forming apparatus according to the twenty-second embodiment, wherein the positioning engaging portion is made of metal material, and the attachment positioning portion is made of resin material and attached to the positioning engaging portion.

A twenty-seventh embodiment is the image forming apparatus according to the twenty-second embodiment, wherein the conveyance frame is formed with a sheet guide portion that guides the sheet.

A twenty-eighth invention is the image forming apparatus according to the twenty-second embodiment, wherein the sheet feeding portion includes a sheet stop roller that controls a feeding timing of the sheet, and the positioning engaging portion includes a bearing fitting portion that is fit to a bearing supporting a rotation axis of the sheet stop roller.

A twenty-ninth embodiment is the image forming apparatus according to the twenty-second embodiment, wherein the image forming portion and the attachment positioning portion are respectively provided in a plural number.

The above described objects and other objects, features, aspects and advantages of the present invention will become more apparent from the following detailed description when taken in conjunction with the accompanying drawings.

DETAILED DESCRIPTION OF NON-LIMITING EXAMPLE EMBODIMENTS

First Embodiment

Figure 1:
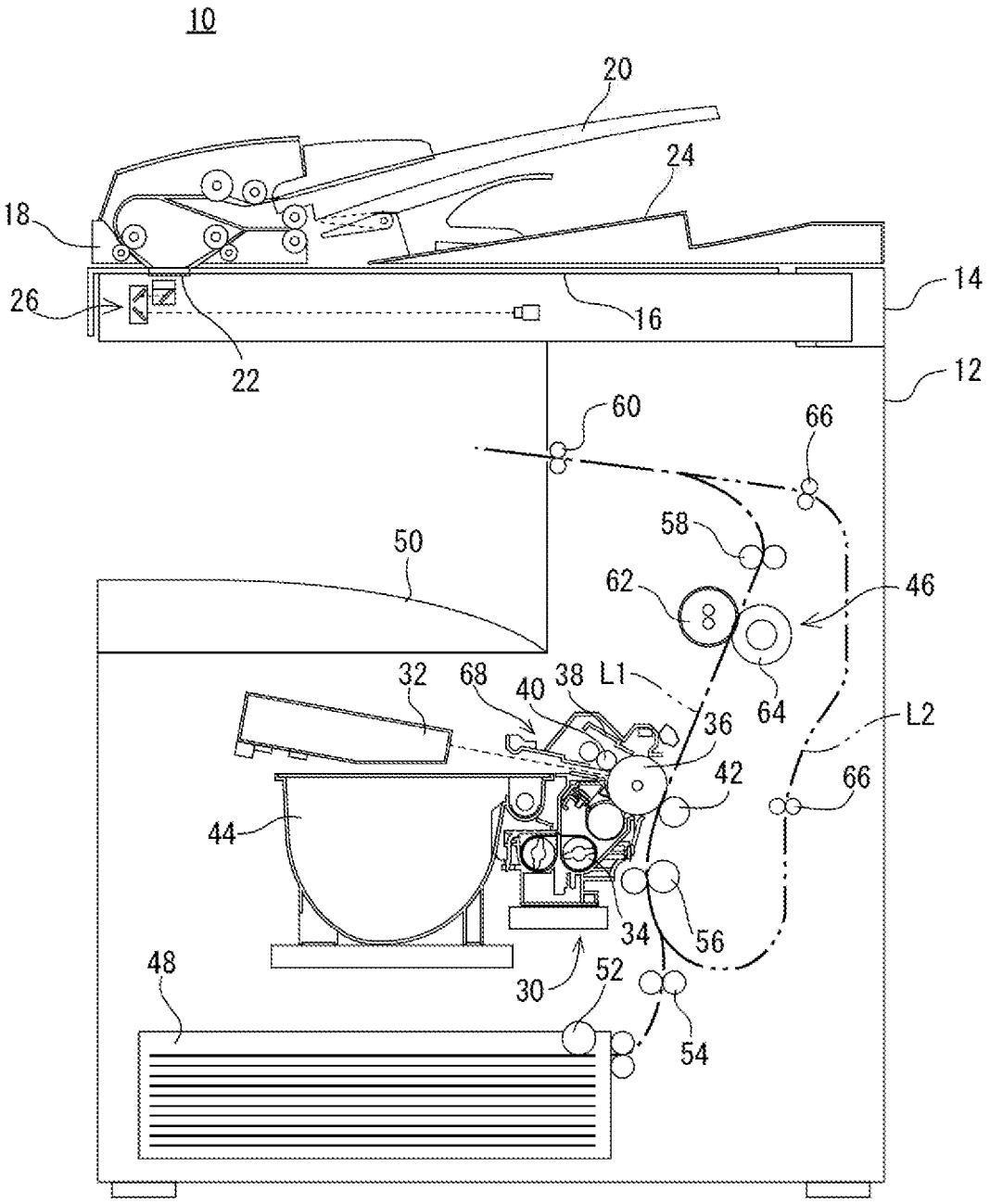
FIG. 1 is an illustration view schematically showing internal structure of an image forming apparatus that is a first embodiment according to the present invention when viewed from a front side.

FIG. 1 is an illustration view schematically showing internal structure of an image forming apparatus that is a first embodiment according to the present invention, when viewed from a front side. With reference to FIG. 1, the image forming apparatus 10 of the first embodiment is a multi-function peripheral having a copy function, a printer function, a scanner function, a facsimile function, etc., and forms a monochromatic image (monochrome image) to a recording medium with an electrophotography system. In addition, as the recording medium, it is possible to use a sheet (paper), overhead projector sheet, etc. In this embodiment, a case where a sheet is used will be described, but it is intended that the term "sheet" covers all the recording medium.

However, in this specification, when the image forming apparatus 10 is viewed from the front, a left side in the horizontal direction is defined as a left direction and a right side is defined as a right direction. Moreover, when the image forming apparatus 10 is viewed from the front, a front side (this side) of the image forming apparatus 10 in the depth direction is defined as a forward direction (front direction) and a rear side (deep side) is defined as a rear direction (back direction).

First, structure of the image forming apparatus 10 will be schematically described. As shown in FIG. 1, the image forming apparatus 10 includes a housing 12 and an image reading apparatus 14 arranged above the housing 12.

The image reading apparatus 14 is provided with an original platen 16 formed of a transparent material. An original platen cover 18 is attached openably and closably above the original platen 16 with a hinge etc. An original tray 20 is provided in an upper surface of the original platen cover 18 in which an automatic document feed (ADF) is provided. The ADF automatically feeds an original put on the original tray 20 one by one to an image reading position 22 so as to discharge onto an original discharge tray.

Moreover, an image scanner 26 incorporated in the image reading apparatus 14 comprises a light source, a plurality of mirrors, a focusing lens, a line sensor, etc. The image scanner 26 exposes a surface of an original by the light source, and leads a reflected light reflected from the original surface to the focusing lens by the plurality of mirrors. Then, the reflected light is focused onto photoreceptor elements of the line sensor by the focusing lens. The line sensor detects brightness and chromaticity of the reflected light focused onto the photoreceptor elements, and generates image data based on an image of the original surface. As the line sensor, a CCD (Charge Coupled Device), a CIS (Contact Image Sensor), etc. may be used.

In the front side of the image reading apparatus 14, there is provided with an operating panel (not shown) that receives an input operation such as a printing instruction etc. by a user. The operating panel includes a display with a touch panel, a plurality of operating buttons, etc.

The housing 12 is provided with a control portion (not shown) including a CPU, a memory, etc. The control portion transmits control signals to respective components of the image forming apparatus 10 in response to an input operation to the operating panel etc. to make the image forming apparatus 10 perform various kinds of operations or actions.

Moreover, various components that the image forming apparatus 10 comprises, such as an image forming portion 30, a fixing unit 46, a driving unit 500 (see FIG. 4, etc.) are incorporated (accommodated) within the housing 12.

The image forming portion 30 comprises an exposure unit (optical scanning unit) 32, a development unit 34, a photoreceptor drum 36, a cleaner unit (cleaning unit) 38, an electrostatic charging unit 40, a transfer roller 42, a toner resupply device 44, etc., and forms an image on a sheet that is fed from a sheet feed tray 48 etc., and discharges the sheet having been formed with the image onto a discharge tray 50. As image data for forming an image on the sheet, image data read by the image scanner 26, image data transmitted from an external computer, etc. can be utilized.

The photoreceptor drum 36 is an image bearing member that a photosensitive layer is formed on a surface of a circular cylindrical substrate having conductivity. The electrostatic charging unit 40 charges a surface of the photoreceptor drum 36 at a predetermined electric potential. The exposure unit 32 is constituted as a laser scanning unit that comprises a laser emitting portion and a reflection mirror, etc., and forms an electrostatic latent image according to the image data on the surface of the photoreceptor drum 36 by exposing the surface of the photoreceptor drum 36 having been charged. The development unit 34 comprises a developer vessel and a developing roller that functions as a developer bearing member, and supplies a toner onto the surface of the photoreceptor drum 36 to visualize the electrostatic latent image that is formed on the photoreceptor drum 36 with the toner (to form a toner image). In addition, a toner density detection sensor that detects a toner density is provided inside the developer vessel. If the toner density detected by this toner density detection sensor becomes lower than a predetermined value, a toner is resupplied to the developer vessel from the toner resupply device 44. The cleaner unit 38 comprises a cleaning blade that is brought into contact with the surface of the photoreceptor drum 36, a feed screw, etc., and removes the toner remaining on the surface of the photoreceptor drum 36 after developing and transfer.

However, in the image forming apparatus 10 of the first embodiment, the development unit 34, the photoreceptor drum 36, the electrostatic charging unit 40 and the cleaner unit 38 are further unitized as a process unit 68 including these components, which is provided in the housing 12 attachably and detachably.

The transfer roller 42 is a member for transferring the toner image that is formed on the surface of the photoreceptor drum 36 onto a sheet. The transfer roller 42 is arranged so as to face the photoreceptor drum 36, and provided to be pressure contacted with the photoreceptor drum 36. At the time of image forming, a transfer electric field is formed between the photoreceptor drum 36 and the transfer roller 42 by applying a predetermined voltage to the transfer roller 42. Then, during when the sheet is passes through a nip region (transfer nip portion) between the photoreceptor drum 36 and the transfer roller 42, the toner image formed on an outer periphery surface of the photoreceptor drum 36 is transferred to the sheet due to an action of this transfer electric field.

The fixing unit 46 comprises a heat roller 62 and a pressure roller 64, and is arranged in a downstream side in a sheet feeding direction compared with the transfer nip portion (image forming portion 30). The heat roller 62 is set so as to become a predetermined fixing temperature (for example, 160° C.), and when the sheet passes through the nip region (fixing nip portion) between the heat roller 62 and the pressure roller 64, the toner image transferred into the sheet is melted, mixed and pressed, whereby the toner image is heat-fixed to the sheet.

Moreover, within such a housing 12, there is formed with a first sheet feeding path L1 for feeding a sheet placed on the sheet feed tray 48 to the discharge tray 50 via the transfer nip portion and the fixing nip portion. Moreover, within the housing 12, there is formed with a second sheet feeding path L2 for returning, in an upstream side in the sheet feeding direction compared with the transfer nip portion, the sheet after a simplex printing is completed and passing through the transfer nip portion and the fixing nip portion to the first sheet feeding path L1 when a duplex printing is to be performed.

A sheet feed roller 52, a before transfer feed roller 54, a sheet stop roller 56, an after fixing feed roller 58 and a discharge roller 60 are provided in the first sheet feeding path L1, and a plurality of duplex printing feed rollers 66 for auxiliarily applying a feeding force to the sheet are suitably provided in the first sheet feeding path L1 and the second sheet feeding path L2. However, in the first paper path L1 of this embodiment, a sheet is fed toward the upstream side from the downstream side. In this specification, when simply referred to as "sheet feeding direction", it means a sheet feeding direction in the first sheet feeding path L1 (direction toward the upstream side from the downstream side).

The sheet feed roller 52 includes a pickup roller and a separation roller, and leads a sheet placed in the sheet feed tray 48 to the first sheet feeding path L1 one by one.

The before transfer feed roller 54 and the after fixing feed roller 58 apply a drive force to the sheet. The before transfer feed roller 54 is arranged in the upstream side in the sheer feeding direction compared with the transfer nip portion and the sheet stop roller 56, and in the downstream side in the sheet feeding direction compared with the sheet feed roller 52. The after fixing feed roller 58 is arranged in the downstream side in the sheet feeding direction compared with the transfer nip portion, and in the upstream side in the sheet feeding direction compared with the discharge roller 60.

The sheet stop roller 56 is arranged in the upstream side in the sheet feeding direction compared with the transfer nip portion, and controls a feeding timing that the sheet is to be sent to the transfer nip portion while applying a drive force to the sheet.

The discharge roller 60 is arranged in the downstream side in the sheet feeding direction compared with the transfer nip portion and the after fixing feeding roller 58, and discharges the sheet on the discharge tray 50. That is, the discharge roller 60 functions as a discharge portion for discharging the sheet fed in the first sheet feeding path L1.

When performing a simplex printing in the housing 12, a sheet placed in the paper feed tray 48 is led to the first sheet feeding path L1 by the sheet feed roller 52, and is fed up to the sheet stop roller 56. Then, the sheet is fed to the transfer nip portion at a timing that a leading edge of the sheet and a leading edge of the image information (toner image) on the photoreceptor drum 36 are aligned with each other, whereby the toner image can be transferred onto the sheet. Thereafter, when the sheet passes through the transfer nip portion, the heat fixing of an unfixed toner on the sheet is performed. The sheet after heat fixing is fed in the first sheet feeding path L1 by the after fixing feeding roller 58 and the discharge roller 60, and is discharged on the discharge tray 50.

On the other hand, a duplex printing is to be performed, the sheet is reversely fed to be led to the second sheet feeding path L2 by making the discharge roller 60 rotate reversely when a trailing edge of the sheet that the simplex printing is completed and passes through the transfer nip portion reaches the discharge roller 60. The sheet led to the second sheet feeding path L2 is fed in the second sheet feeding path L2 by the duplex printing sheet feed roller 66 to be led to the first sheet feeding path L1 in the upstream side in the sheet feeding direction compared with the sheet stop roller 56. Since the front and back of the sheet is reversed at this point, when the sheet then passes the transfer nip portion and the fixing nip portion, a printing is performed onto the back surface of the sheet.

Moreover, although illustration is omitted, the image forming apparatus 10 is provided with a manual sheet feed tray. The manual sheet feed tray is arranged in the upstream side in the sheet feeding direction compared with the before transfer roller 54, and a sheet may be fed from the manual sheet feed tray to the first sheet feeding path L1.

Furthermore, the above-described image forming apparatus 10 may be provided with an external sheet feed unit. In this case, a sheet may be fed from the external sheet feed unit to the first sheet feeding path L1 instead of the sheet feed tray 48 or the manual sheet feed tray.

Figure 2:
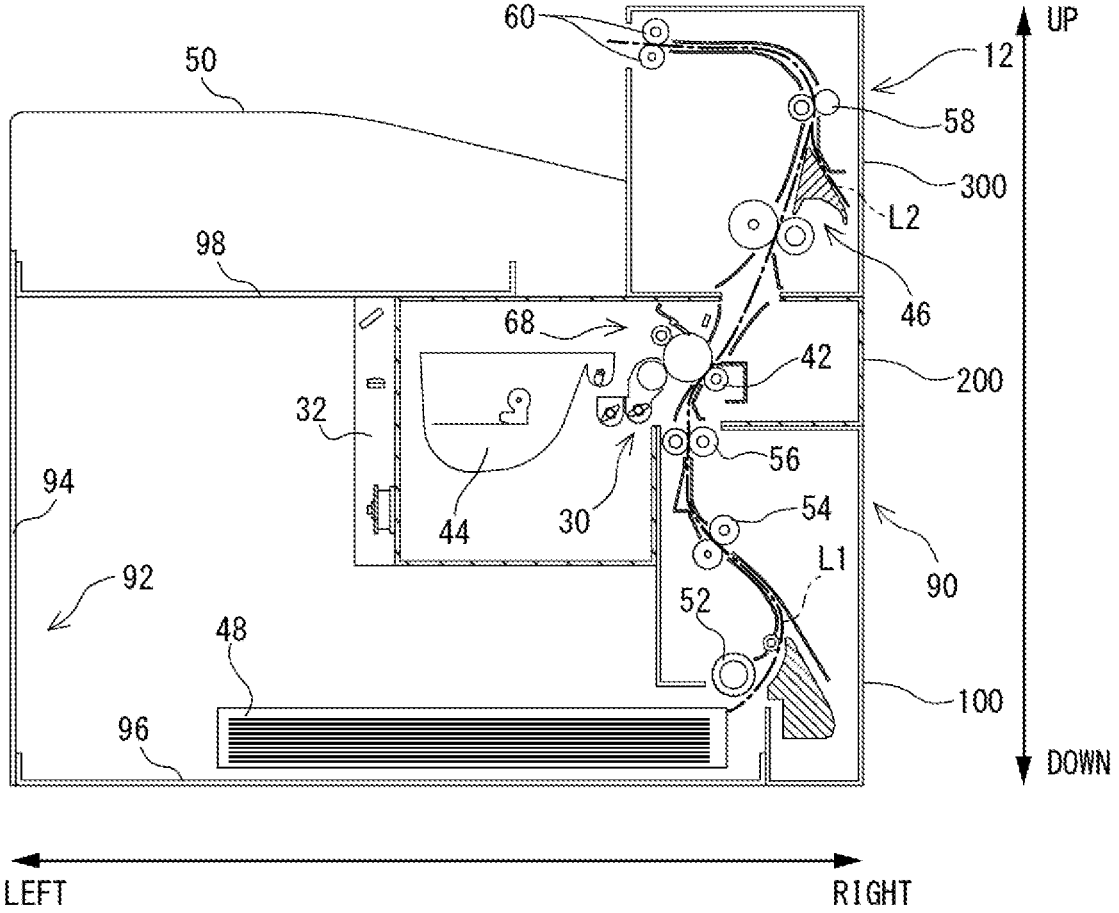
FIG. 2 is an illustration view schematically showing structure of a housing provided in the image forming apparatus of FIG. 1.
Figure 3:
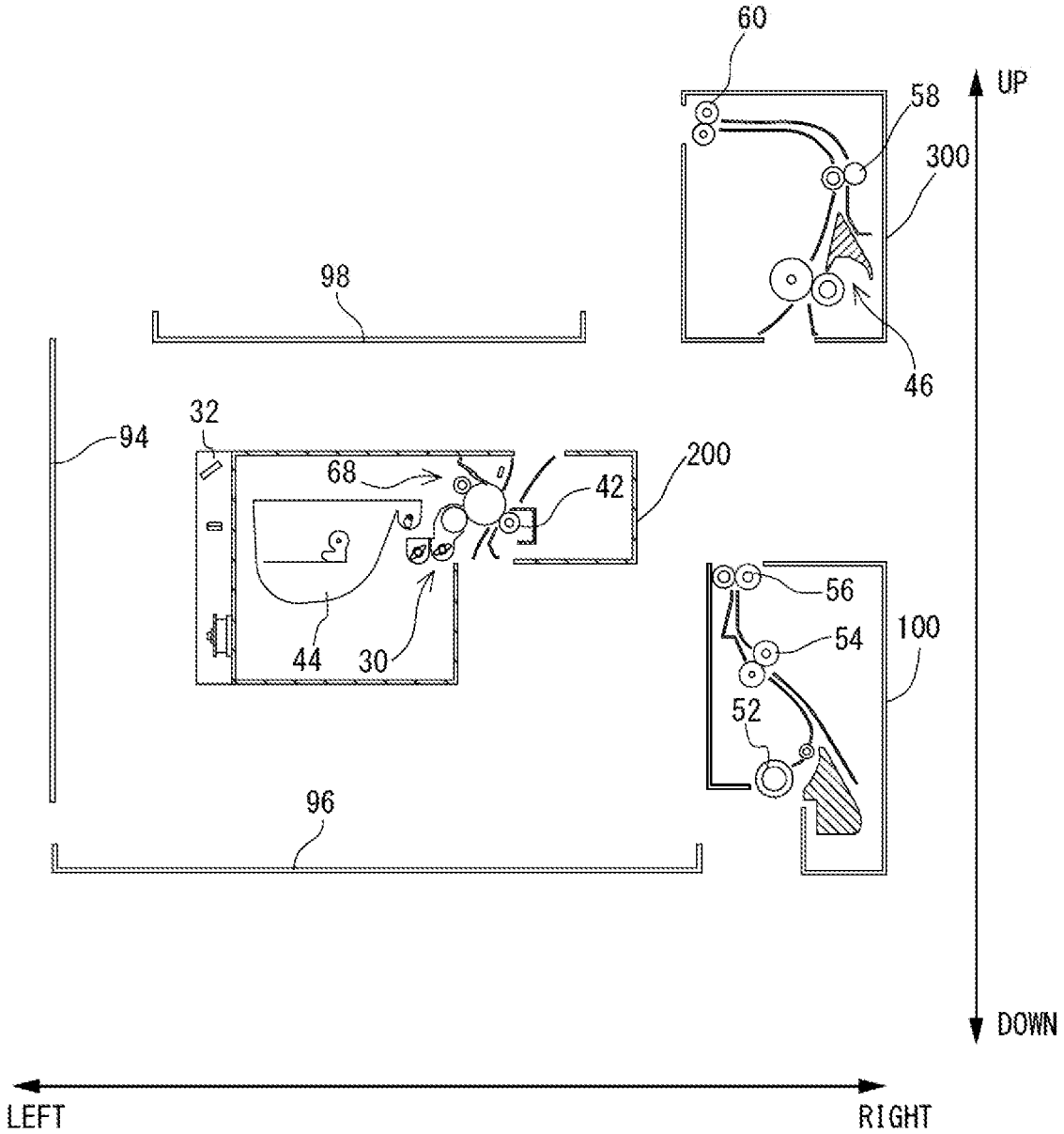
FIG. 3 is an illustration view schematically showing the structure when disassembling the housing of FIG. 2.
Figure 4:
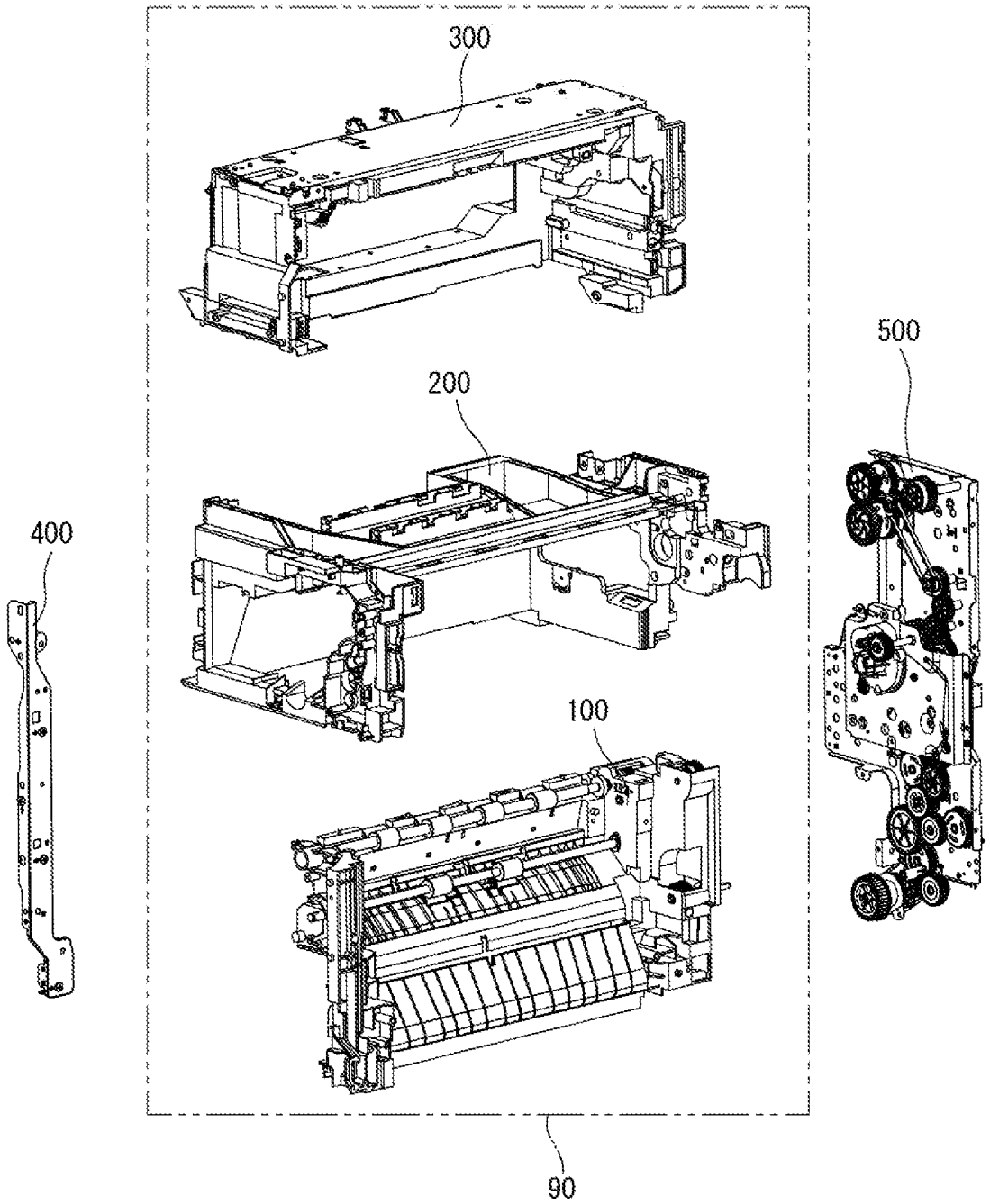
FIG. 4 is a schematic perspective view showing a resin frame and a coupling member attached thereto.

Next, with reference to FIG. 2-FIG. 4, schematic structure of the housing 12 according to this embodiment. In addition, in FIG. 2-FIG. 4, illustration of the image reading apparatus 14 is omitted.

As shown in FIG. 2-FIG. 4, the housing 12 is constructed by a combination of a resin frame 90 and a metal frame 92. That is, a part of the housing 12 is constructed by the resin frame 90, and another part of the housing 12 is constructed by the metal frame 92.

As shown in FIG. 2 and FIG. 3, in this embodiment, as for the housing 12, a portion constituting the first sheet feeding path L1 and the second sheet feeding path L2, and a portion supporting the image forming portion 30, the fixing unit 46 and the driving unit 500 are constructed by the resin frame 90, and other portions are constructed by the metal frame 92. In addition, in FIGS. 2 and 3, a detailed illustration of the second sheet feeding path L2 is omitted.

Therefore, as for the housing 12, a side provided with the first sheet feeding path L1 and the second sheet feeding path L2 (right side in this embodiment) is constructed by the resin frame 90, and an opposite side (left side in this embodiment) is constructed by the metal frame 92.

Moreover, the metal frame 92 is constituted by a plurality of frames. Specifically, the metal frame 92 includes a side plate frame 94, a first coupling frame 96 and a second coupling frame 98.

The side plate frame 94 is a frame made of a rectangular metal plate, and forms a side wall (left side wall) on an opposite side of the first sheet feeding path L1 and the second sheet feeding path L2 in the housing 12.

The first coupling frame 96 couples a lower end portion of the resin frame 90 (conveyance frame 100 described later) and a lower end portion of the side plate frame 94 to each other.

The second coupling frame 98 couples an upper surface of the resin frame 90 (process frame 200 described later) and an upper end portion of the side plate frame 94 to each other. However, the second coupling frame 98 is arranged below a sheet discharge port provided on the resin frame 90 (fixation frame 300 described later), and the discharge tray 50 is provided above an upper surface of the second coupling frame 98.

In addition, since the first coupling frame 96 and the second coupling frame 98 are not required to have higher strength than the side plate frame 94, and also not required to have high dimensional precision, the first coupling frame 96 and the second coupling frame 98 may have a small size in a width direction (front-rear direction).

As shown in FIG. 2-FIG. 4, the resin frame 90 is divided in the sheet feeding direction. Specifically, the resin frame 90 is divided into three frames of the conveyance frame 100, the process frame 200 and the fixation frame 300.

The conveyance frame 100 is arranged in the most upstream side in the sheet feeding direction out of the three frames constituting the resin frame 90 (in the upstream in the sheet feeding direction compared with the process frame 200 and the fixation frame 300). Specifically, the conveyance frame 100 is arranged in a lower end portion (right lower end portion) of a side that is provided with the first sheet feeding path L1 and the second sheet feeding path L2, and below the process frame 200 and the fixation frame 300.

This conveyance frame 100 supports components in the upstream side in the sheet feeding direction compared with the sheet stop roller 56. That is, the conveyance frames 100 supports the sheet feed roller 52, the before transfer roller 54, the sheet stop roller 56, a sheet feed roller for the manual sheet feed tray and some feed rollers for duplex printing 66 (hereinafter, these components may be collectively and simply referred to as "sheet feeding portion"). In addition, the sheet feed roller 52 itself may be supported by the sheet feed tray 48, and the conveyance frame 100 may support only the drive portion of the sheet feed roller 52.

The process frame 200 is arranged in the downstream side in the sheet feeding direction compared with the conveyance frame 100 out of three frames constituting the resin frame 90, and is arranged in the upstream side in the sheet feeding direction compared with the fixation frame 300. That is, the process frame 200 is arranged between the fixation frame 300 and the conveyance frame 100.

This process frame 200 supports respective components (the exposure unit 32, the development unit 34, the photoreceptor drum 36, the cleaner unit 38, the electrostatic charging unit 40, the transfer roller 42 and the toner resupply device 44) of the image forming portion 30 (process unit 68).

The fixation frame 300 is arranged in the most downstream side in the sheet feeding direction (downstream side in the sheet feeding direction compared with conveyance frame 100 and the process frame 200) out of the three frames constituting the resin frame 90. That is, the fixation frame 300 is arranged so as to be stacked on the conveyance frame 100 and the process frame 200.

This fixation frame 300 supports the fixing unit 46, the after fixing feed roller 58 and the discharge roller 60 (hereinafter, these components may be collectively and simply referred to as "fixing discharge portion").

However, the conveyance frame 100, the process frame 200 and the fixation frame 300 are formed with resin materials of kinds different from each other.

For example, because the fixation frame 300 supports the fixing unit 46 that becomes high in temperature, heat resistance is required compared with the conveyance frame 100 and the process frame 200. Therefore, the fixation frame 300 is formed of a resin material having higher heat resistance than those of the conveyance frame 100 and the process frame 200.

Moreover, since respective components of the image forming portion 30 affect quality of an image printed by the image forming portion 30, high positional precision is required for the attaching position. Therefore, the process frame 200 that supports the respective components of the image forming portion 30 is required to have higher dimensional precision (higher dimensional stability) than the conveyance frame 100 and the fixation frame 300. Therefore, the process frame 200 is formed of a resin material that is higher dimensional precision than those of the conveyance frame 100 and the fixation frame 300.

In addition, the conveyance frame 100 includes a feeding path forming portion for forming a part of first sheet feeding path L1. Since the fixation frame 300 includes the fixing discharge portion, it includes parts of each of first sheet feeding path L1 and second sheet feeding path L2. The process frame 200 includes a part of first sheet feeding path L1 since it supports the image forming portion 30.

That is, respective feeding path forming portions included in the respective frames are coupled to each other by combining (mounting) the conveyance frame 100, the process frame 200 and the fixation frame 300 with each other, thereby forming the first sheet feeding path L1 and the second sheet feeding path L2.

In addition, although detailed description is omitted, a part of the second sheet feeding path L2 may be arranged, in a movable manner, within a common space that is formed by the conveyance frame 100, the process frame 200 and the fixation frame 300. With such a configuration, when accumulation of the sheet (sheet jam, jam) occurs within the first sheet feeding path L1, it is possible to remove the accumulated sheet by moving the part of the second sheet feeding path L2. Furthermore, a guide portion that guides the sheet fed from the second sheet feeding path L2 may be provided in the conveyance frame 100.

Moreover, as shown in FIG. 4, a coupling member 400 and the driving unit 500 are attached to the resin frame 90. The coupling member 400 and the driving unit 500 are arranged outside an area where the first sheet feeding path L1 and the second sheet feeding path L2 of the resin frame 90 are formed (outside the front-rear direction). Specifically, the coupling member 400 is attached to a front end portion (front surface) of the resin frame 90, and the driving unit 500 is attached to a rear end portion (rear surface) of the resin frame 90. In addition, specific structure of the coupling member 400 and the driving unit 500 will be described later.

Next, with reference to FIG. 4-FIG. 11, mutual attaching structure of the conveyance frame 100, the process frame 200 and the fixation frame 300 will be described.

Figure 5:
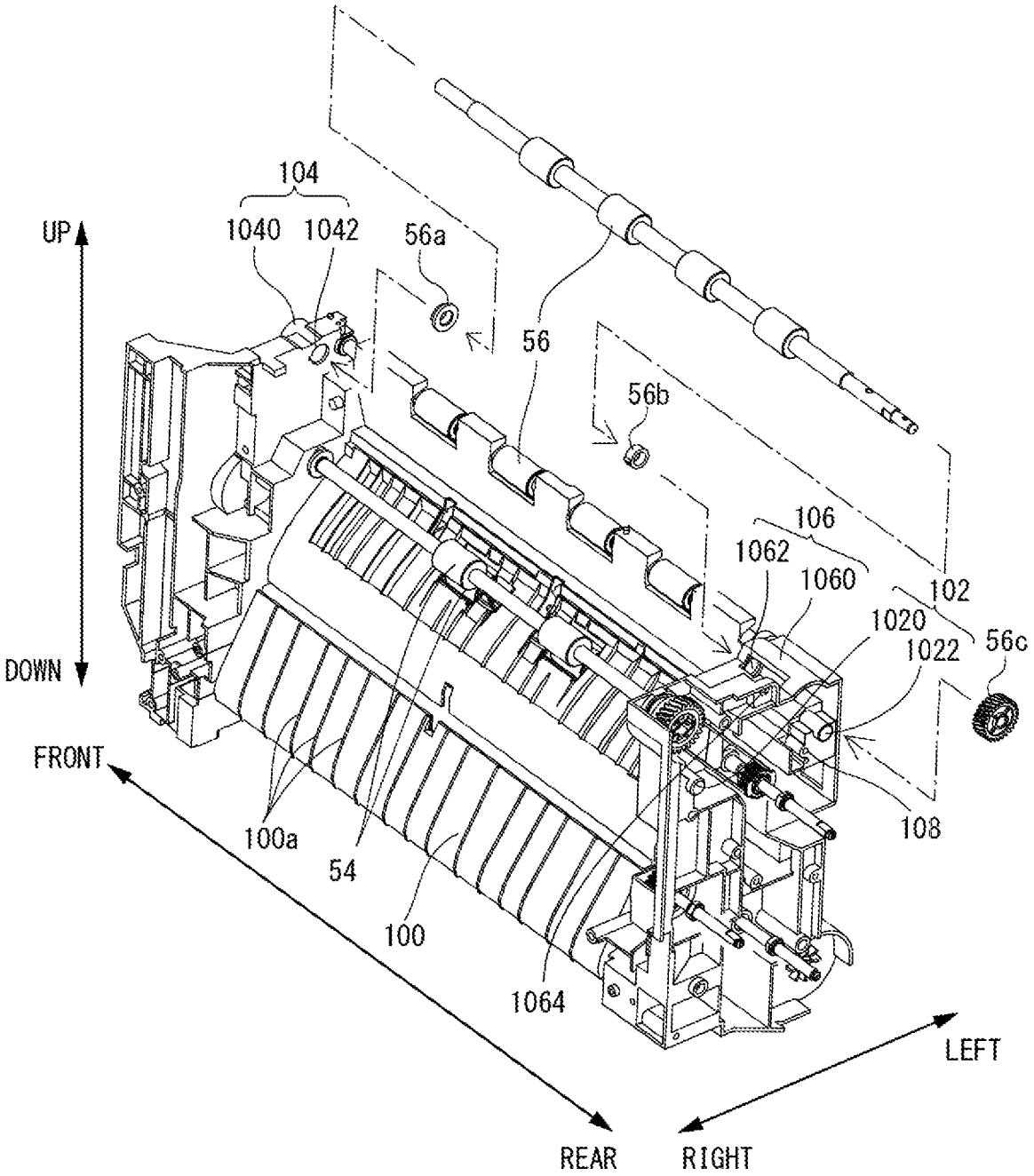
FIG. 5 is a schematic perspective view showing structure of a conveyance frame.

First, as shown in FIG. 5, on the conveyance frame 100, a part of first sheet feeding path L1 is formed between the sheet feed roller 52 and the sheet stop roller 56, and especially, a sheet guide portion 100*a* formed with ribs that guide a sheet is provided between the sheet feed roller 52 and the before transfer roller 54.

Figure 6:
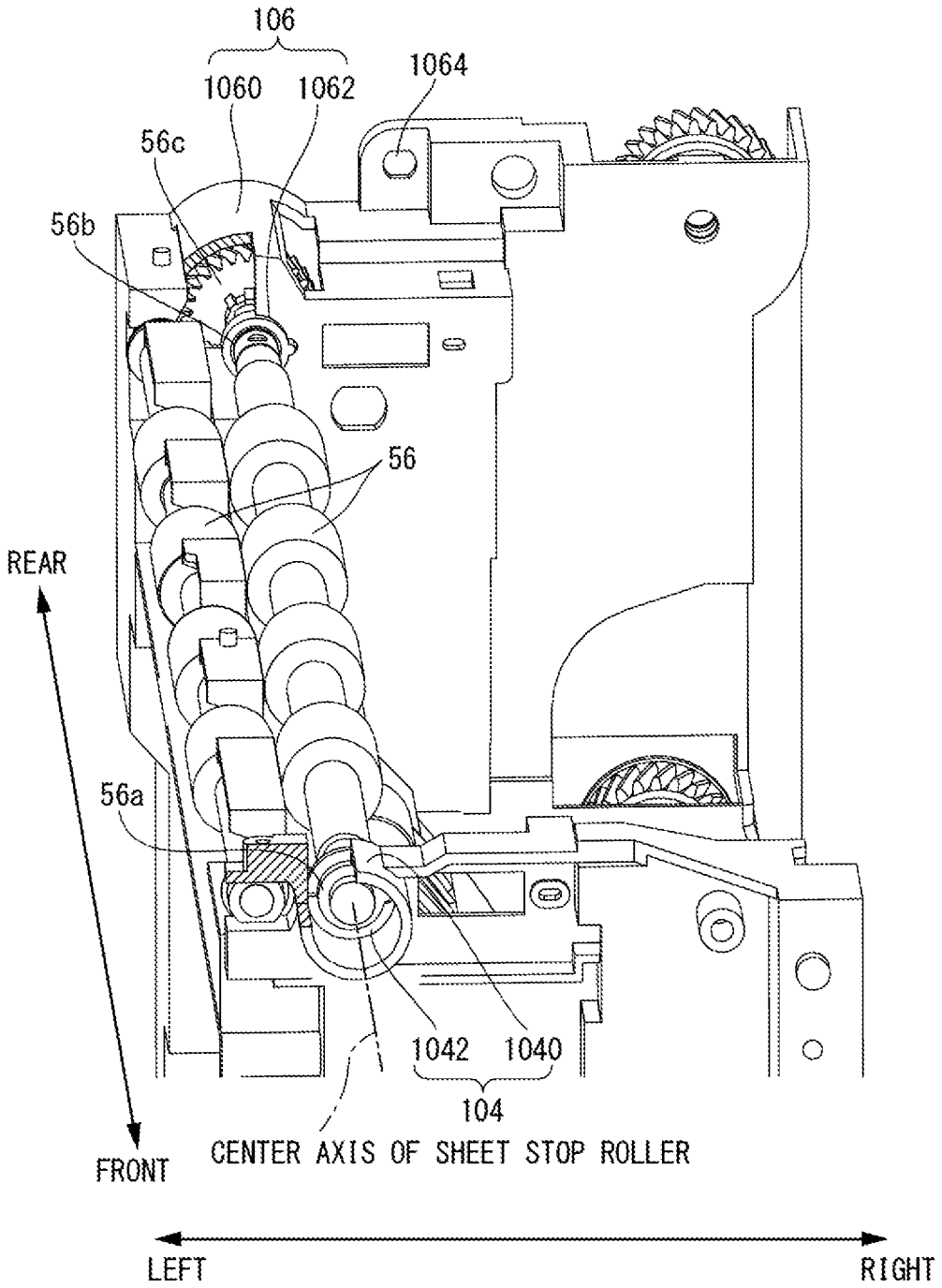
FIG. 6 is a schematic perspective view showing support structure of a sheet stop roller.
Figure 7:
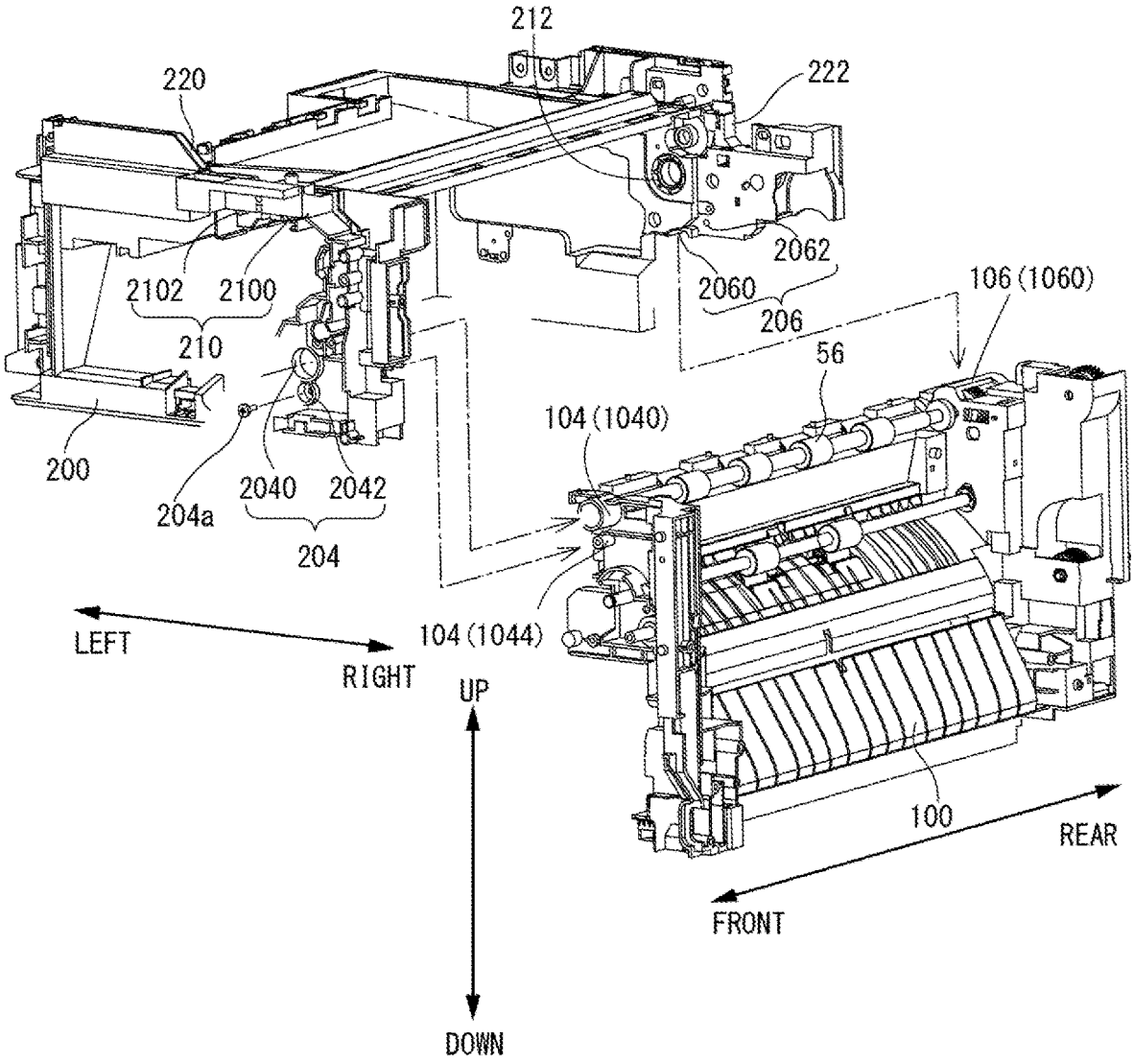
FIG. 7 is a schematic perspective view showing attaching structure of a process frame to the conveyance frame.

Moreover, as shown in FIG. 5-FIG. 7, the conveyance frame 100 includes a front side frame positioning portion 104, a rear side frame positioning portion 106, a driving unit positioning portion 102 and a first fastening portion 108.

The driving unit positioning portion 102 is provided for positioning the driving unit 500, and includes two fitting protruding portions 1020 and 1022 that are provided on the rear surface of the conveyance frame 100 to be protruded rearwardly. The fitting protruding portions 1020 and 1022 are each formed in a substantially cylindrical shape, and arranged in positions separated from each other by a predetermined distance in the front-rear direction. Moreover, the fitting protruding portions 1020 and 1022 are arranged at substantially the same height in an up-down direction.

The front side frame positioning portion 104 and the rear side frame positioning portion 106 are provided for positioning the process frame 200.

The front side frame positioning portion 104 is provided on an upper end of the front surface side of the conveyance frame 100, and includes an engaging portion 1040, a bearing support portion 1042 and a fastening portion 1044. Moreover, the rear side frame positioning portion 106 is provided on an upper end of the rear surface side of the conveyance frame 100, and includes an engaging portion 1060, a bearing support portion 1062 and a fastening portion 1064.

The bearing support portion 1042 and the bearing support portion 1062 are through holes each having substantially circular shape in cross-section, which are formed coaxially with the driving axis of the sheet stop roller 56. The bearing support portion 1042 supports a front end portion of the driving axis of the sheet stop roller 56 via a bearing 56*a* that is attached to one end portion (front end portion) of the driving axis of the sheet stop roller 56, and the bearing support portion 1062 supports a rear end portion of the driving axis of the sheet stop roller 56 via a bearing 56*b* that is attached to another end portion (rear end portion) of the driving axis of the sheet stop roller 56.

That is, the sheet stop roller 56 is supported by the bearing support portion 1042 and the bearing support portion 1062 formed coaxially with each other. Moreover, a drive gear 56*c* of the sheet stop roller 56 is attached to the rear end (rear surface side compared with the bearing support portion 1062) of the driving axis of the sheet stop roller 56.

The engaging portion 1040 and the engaging portion 1060 are formed with the driving axis (center axis) of the sheet stop roller 56 as the reference. The engaging portion 1040 and the engaging portion 1060 include a substantially arc-shaped upper surface (first engaging surface) that is formed with the driving axis of the sheet stop roller 56 as the reference. Moreover, upper surfaces of the engaging portion 1040 and the engaging portion 1060 are formed coaxially with the bearing support portion 1042 and the bearing support portion 1062 so as to be protruded upwardly (downstream side in the sheet feeding direction).

In this embodiment, the engaging portion 1040 is formed in a substantially cylindrical shape extended in the front-rear direction so as to cover an outside of the bearing support portion 1042, and the engaging portion 1060 is formed to be extended in the front-rear direction in an arch shape of a substantially semi-circular in cross section so as to cover above the bearing support portion 1062.

As shown in FIG. 7, the fastening portion 1044 is provided on the front surface of the conveyance frame 100, which is a protruding portion (boss) of a substantially cylindrical shape having a threaded hole into which a screw (securing tool) for securing the process frame 200 to the conveyance frame 100 is inserted. The fastening portion 1044 is arranged near the engaging portion 1040.

Returning to FIG. 5, the engaging portion 1064 is provided in the rear surface of the conveyance frame 100, which is a hole into which a securing screw (securing tool) for securing the process frame 200 to the conveyance frame 100 is inserted. The fastening portion 2062 to which this securing screw is attached is formed in the process frame 200. The first fastening portion 108 is a threaded hole provided on the rear surface of the conveyance frame 100, to which a screw (securing tool) for securing the driving unit 500 to the conveyance frame 100 is inserted. The first fastening portion 108 is arranged between the fitting protruding portions 1020 and 1022.

Figure 8:
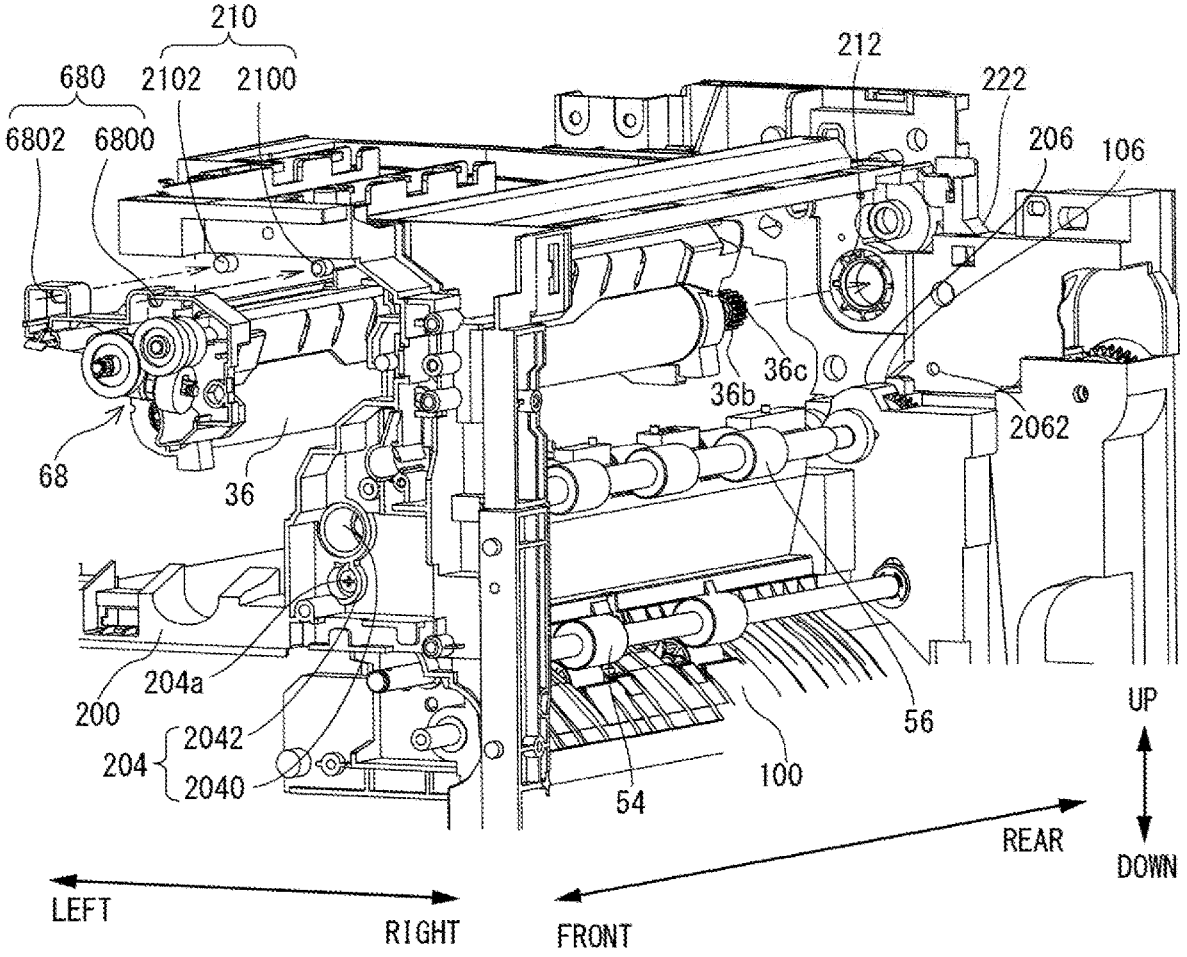
FIG. 8 is a schematic perspective view showing positioning structure of the process unit.

Next, as shown in FIG. 7 and FIG. 8, the process frame 200 includes a front side frame positioning portion 204, a rear side frame positioning portion 206, a front side process positioning portion 210, a rear side process positioning portion 212, a front side guide portion 220 and a rear side guide portion 222.

The front side frame positioning portion 204 and the rear side frame positioning portion 206 are provided for positioning the process frame 200.

The front side frame positioning portion 204 is provided on a lower end of the front end portion of the process frame 200, and includes an engaging portion 2040 and a fastening portion 2042. The rear side frame positioning portion 206 is provided on a lower end of the rear end portion of the process frame 200, and includes an engaging portion 2060 and a fastening portion 2062.

The front side engaging portion 2040 is provided in a position and shape corresponding to those of the engaging portion 1040 of the conveyance frame 100. The front side engaging portion 2060 is provided in a position and shape corresponding to those of the engaging portion 1060 of the conveyance frame 100.

Specifically, the front side engaging portion 2040 and the rear side engaging portion 2060 include a lower surface (second engaging surface) of a substantially arc-shaped formed with a rotation axis of the sheet stop roller 56, specifically, the driving axis as the reference. Moreover, the second engaging surface of the engaging portion 2040 and the second engaging surface of the rear side frame positioning portion 206 are formed in shapes corresponding to upper surfaces (first engaging surface) of the engaging portion 1040 and the engaging portion 1060.

More specifically, the engaging portion 2040 is a through hole having a substantially circular shape in cross section, and an inner diameter of the engaging portion 2040 is set to be slightly larger than an outer diameter of the engaging portion 1040 of the conveyance frame 100.

Then, when the engaging portion 2040 of the process frame 200 (front side frame positioning portion 204) and the engaging portion 1040 of the conveyance frame 100 (front side frame positioning portion 104) are engaged with each other, and the engaging portion 2060 of the process frame 200 (rear side frame positioning portion 206) and the engaging portion 1060 of the conveyance frame 100 (rear side frame positioning portion 106) are engaged with each other, the process frame 200 can be positioned with respect to the conveyance frame 100 with the driving axis of the sheet stop roller 56 as the reference.

That is, the front side frame positioning portion 104 and the rear side frame positioning portion 106 function as an engaging portion (equivalent to the first engaging portion) of the conveyance frame 100 side, and the front side frame positioning portion 204 and the rear side frame positioning portion 206 function as an engaging portion (equivalent to the second engaging portion) of the process frame 200 side.

The front side process positioning portion 210 and the rear side process position portion 212 are provided for positioning the process unit 68 with respect to the process frame 200.

The front side process positioning portion 210 is provided on the front surface of the process frame 200, and includes two fitting protruding portions 2100 and 2102 that are provided to be protruded toward the front side. The fitting protruding portions 2100 and 2102 are each formed in a substantially cylindrical shape, and arranged in positions separated from each other in the front-rear direction by a predetermined distance.

Moreover, as shown in FIG. 8, a process side positioning portion 680 is provided in a front end portion of the process unit 68 including the photoreceptor drum 36. The process side positioning portion 680 includes two fitting holes 6800 and 6802 corresponding to the fitting protruding portions 2100 and 2102, respectively. When the fitting protruding portion 2100 is fit into the fitting hole 6800 and the fitting protruding portion 2102 is fit into the fitting hole 6802, the position of the front end portion of the process unit 68 (image formation portion 30) with respect to the process frame 200 is settled.

However, one of the fitting holes 6800 and 6802 (in this embodiment, fitting hole 6800 in the right side) is a through hole (reference hole) of a substantially perfect circular shape in cross section corresponding to the fitting protruding portion 2100, and the other of the fitting holes 6800 and 6802 (in this embodiment, fitting hole 6802 in the left side) is a long hole (slot hole) extending in the left-right direction. Therefore, the fitting hole 6800 serves as the reference and the fitting hole 6802 functions as a rotation stopper against the fitting hole 6800. In addition, in a combination of a fitting hole 4020 and a fitting hole 4022, a combination of a fitting hole 4060 and a fitting hole 4062, a combination of a fitting hole 7020 and a fitting hole 7022 and a combination of a fitting hole 5520 and a fitting hole 5522, it is the same that one of each combination serves as the reference hole and the other of each combination functions as a rotation stopper.

The rear side process positioning portion 212 is a through hole of a substantially circular shape formed coaxially with a driving axis 36 of the photoreceptor drum 36, and supports a bearing **36*b* of the photoreceptor drum 36. An inner diameter of the rear side process positioning portion 212 is set to be slightly larger than an outer diameter of the bearing 36*b* of the photoreceptor drum 36. When the bearing 36*b* of the photoreceptor drum 36 is fit into the rear side process positioning portion 212, the position of the rear end portion of the process unit 68 (image formation module 30) with respect to the process frame 200** is settled.

As described above, the process unit 68 is positioned by the front side process positioning portion 210 and the rear side process positioning portion 212 of the process frame 200, and by the process side positioning portion 680 of the process unit 68 and the bearing **36*b* of the photoreceptor drum 36**.

Returning to FIG. 7, a front side guide portion 220 and a rear side guide portion 222 are provided for guiding the fixation frame 300 to a predetermined position on the process frame 200 prior to the positioning and securing of the fixation frame 200 to the conveyance frame 100 is performed.

The front side guide portion 220 is an inclined surface provided on an upper surface of the front end portion of the process frame 200, and inclined downwardly as it goes the right. The rear side guide portion 222 is a groove having a substantially U-letter shape in cross section, which is provided on an upper surface of the rear end portion of the process frame 200.

Figure 9:
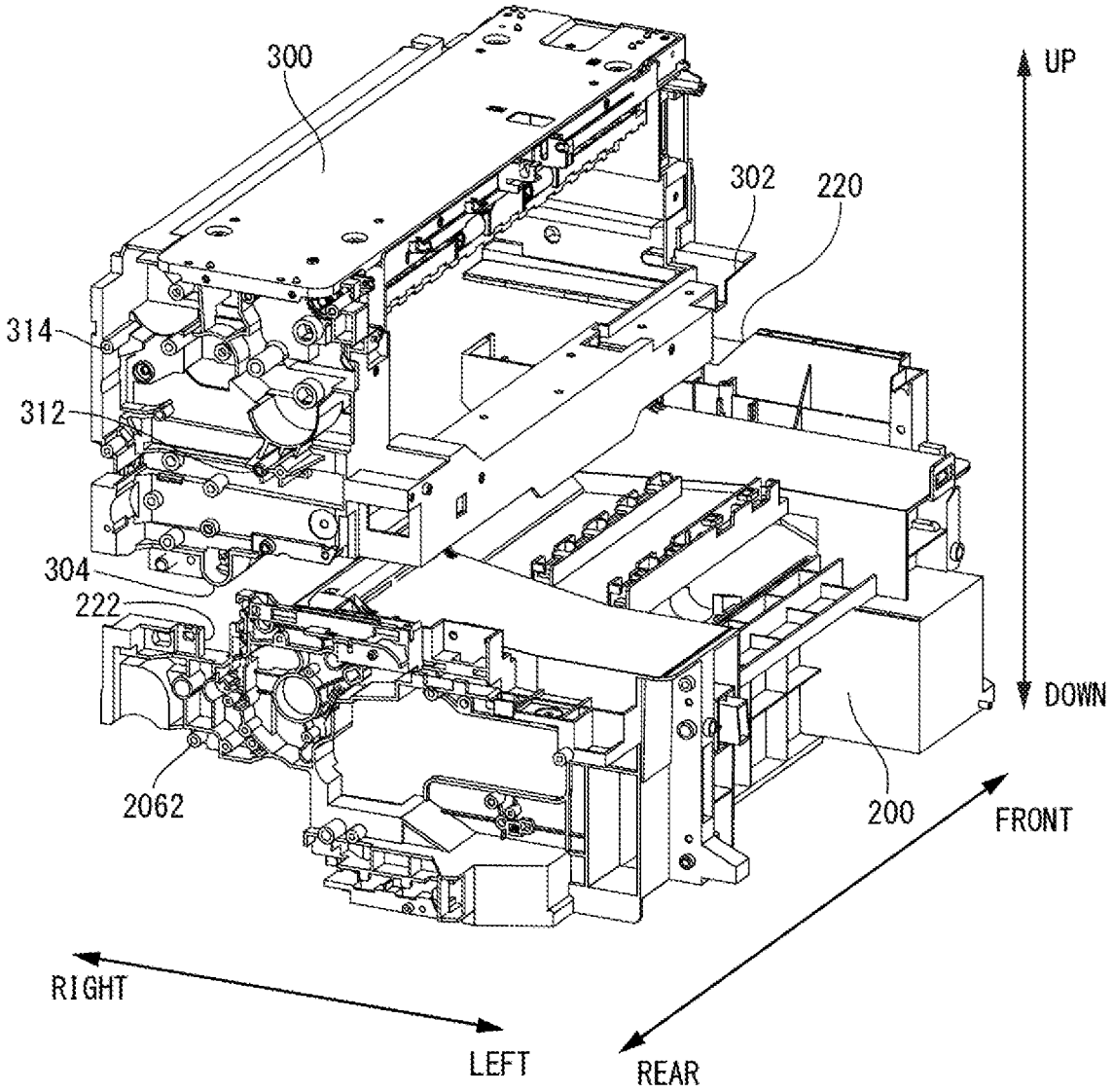
FIG. 9 is a schematic perspective view showing guide structure of a fixation frame with respect to the process frame.
Figure 10:
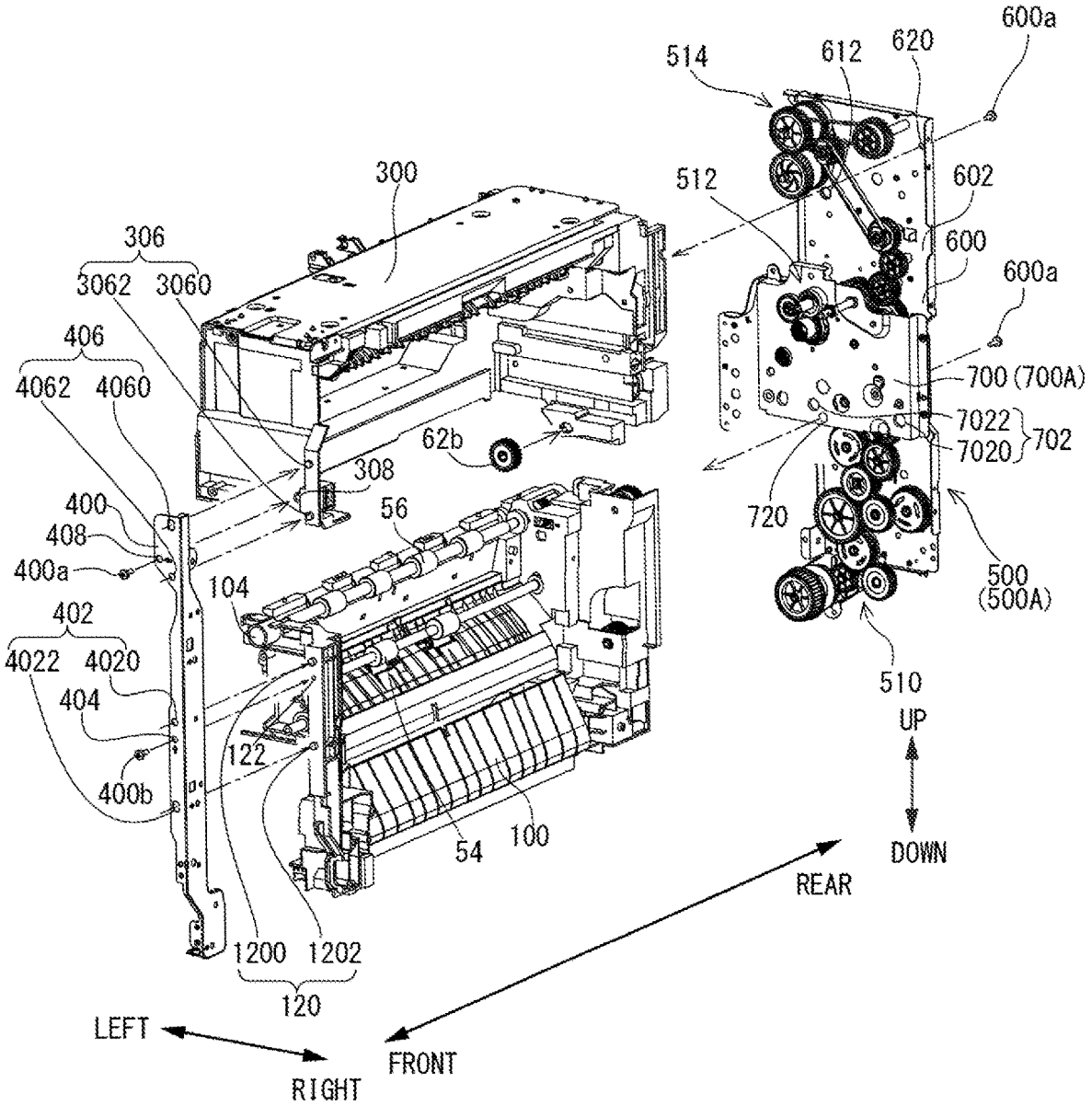
FIG. 10 is a schematic perspective view showing attaching structure of the conveyance frame, the fixation frame and a driving unit.
Figure 11:
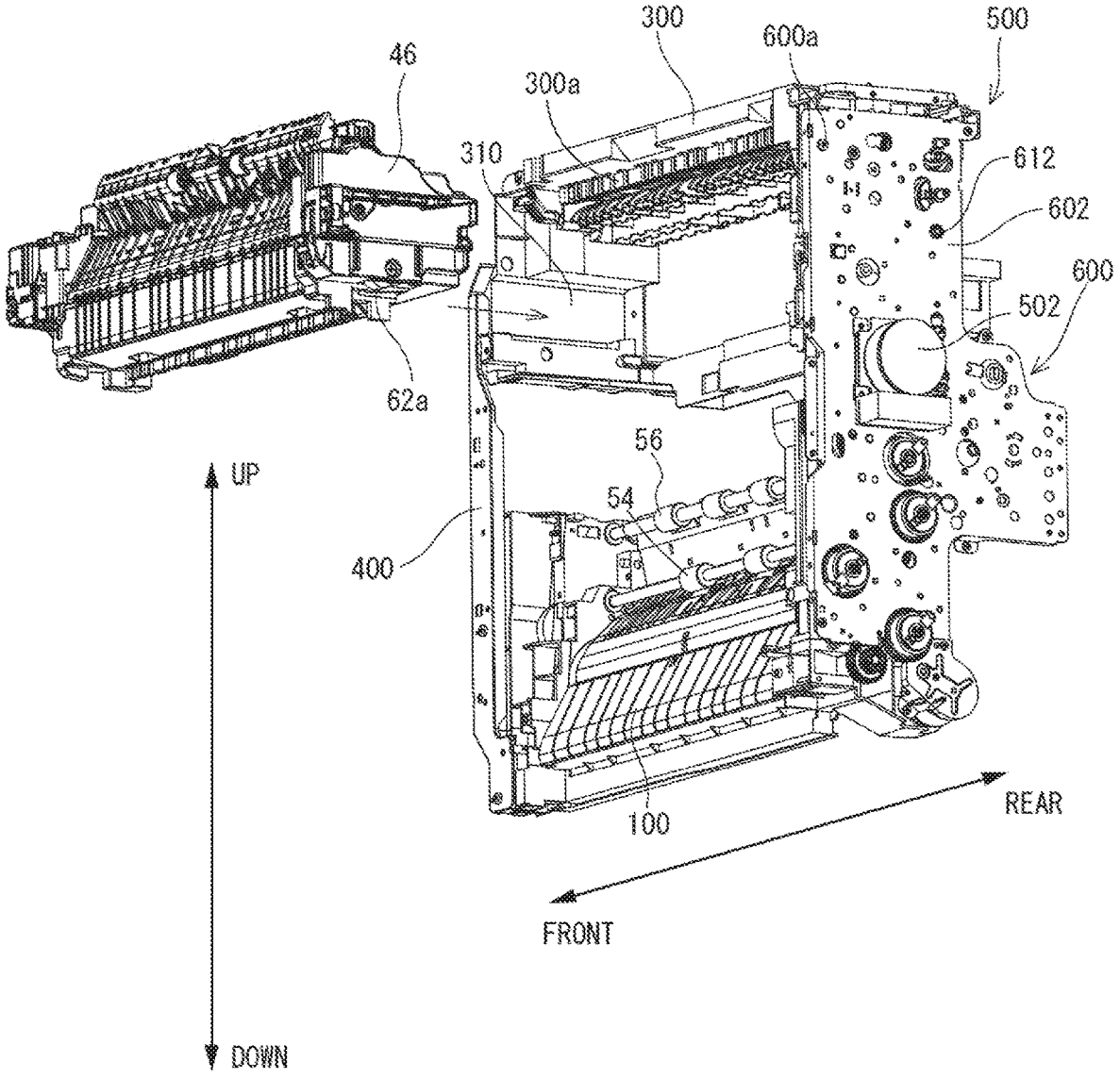
FIG. 11 is a schematic perspective view showing attaching structure of the fixation frame and a fixing unit.
Figure 12:
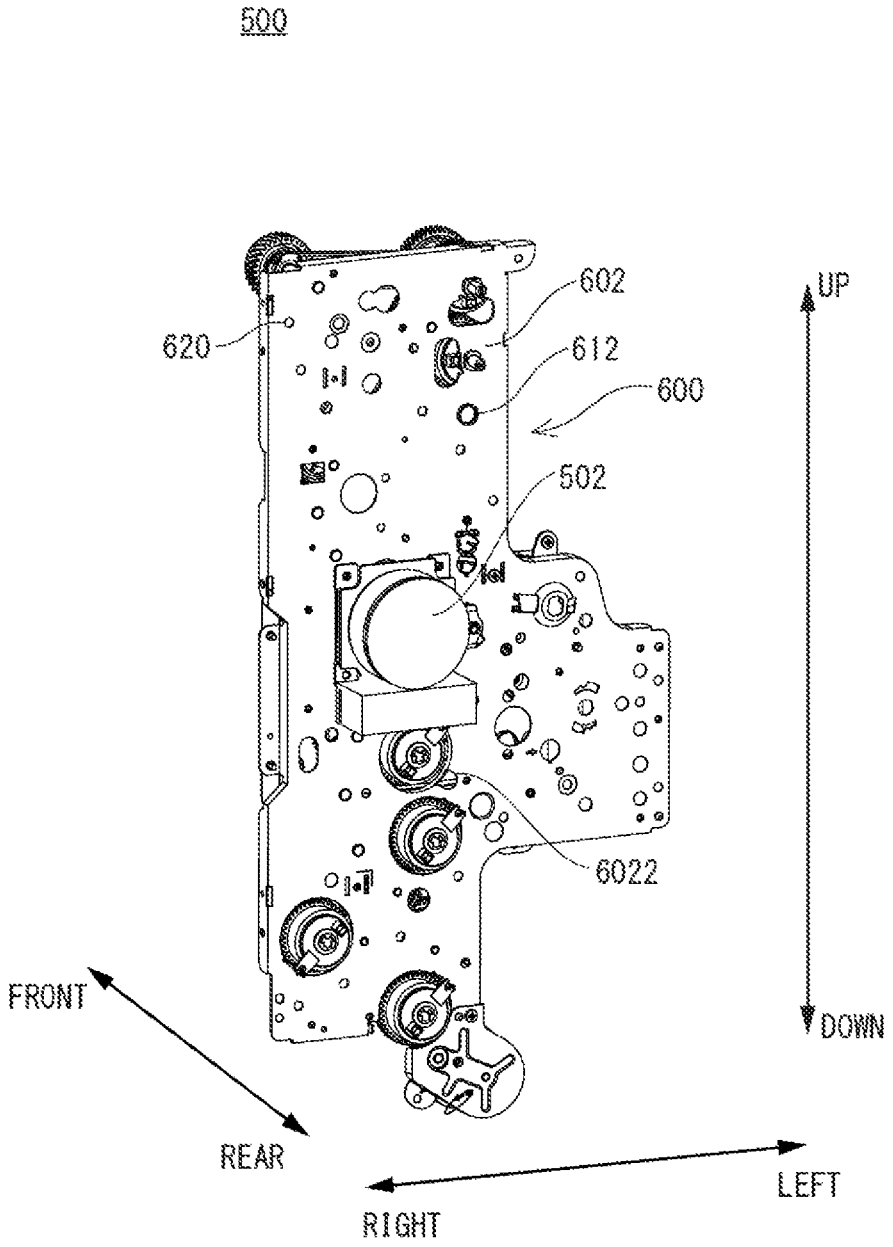
FIG. 12 is a schematic perspective view showing structure of the driving unit when viewed from one side.

Next, as shown in FIG. 9-FIG. 11, the fixation frame 300 includes a front side guide portion 302 and a rear side guide portion 304.

FIG. 9 is a schematic perspective view showing guide structure of the fixation frame 300 to the process frame 200, and the fixation frame 300 and the process frame 200 are drawn in a separated state for description. As shown in FIG. 9, the front side guide portion 302 is a left end edge (left edge) of a front end portion of the fixation frame 300. This front side guide portion 302 is formed in a position corresponding to the front side guide portion 220 of the process frame 200.

The rear side guide portion 304 is a protruding portion provided on a lower surface of a rear end portion of the fixation frame 300 to be protruded downwardly. This rear side guide portion 304 is formed in a position and a shape corresponding to those of the rear side guide portion 222 of the process frame 200.

By such a configuration, when placing the fixation frame 300 on the process frame 200, in the front surface side of the fixation frame 300, the front side guide portion 302 is brought into contact to the front side guide portion 220 that is the inclined surface, whereby the front side guide portion 302 is moved downwardly while restricting a movement toward the left of the fixation frame 300. Moreover, the front side guide portion 302 and the lower end portion of the front side guide portion 220 are brought into contact with each other, whereby a movement toward the left of the fixation frame 300 is restricted.

Moreover, when placing the fixation frame 300 on the process frame 200, in the rear surface side of the fixation frame 300, since the rear side guide portion 304 is moved along the rear side guide portion 222, the rear side guide portion 304 and the rear side guide portion 222 are fit to each other, whereby a movement in the left-right direction of the fixation frame 300 is restricted. Therefore, the fixation frame 300 is stably supported on the process frame 200 in a predetermined position.

As shown in FIG. 10, in a state where the process frame 200 (not shown) is attached to the conveyance frame 100 and the fixation frame 300 is placed on the process frame 200, the fixation frame 300 is attached to the conveyance frame 100 via the coupling member 400 and the driving unit 500. In addition, in FIG. 10, in order to intelligibly show detailed structure that the fixation frame 300 is attached to the conveyance frame 100, illustration of the process frame 200 is omitted.

Specifically, the fixation frame 300 is attached, in the front side thereof to the conveyance frame 100 via the coupling member 400, and is attached, in the rear side thereof to the conveyance frame 100 via the driving unit 500.

The coupling member 400 is a metal plate that has a substantially L-letter shape in cross-section, and is extended in the up-and-down direction. This coupling member 400 is provided so as to cover right front portions of the conveyance frame 100, the process frame 200 and the fixation frame 300.

Moreover, the conveyance frame 100 includes a coupling member positioning portion 120 and a fastening portion 122, and the fixation frame 300 includes a coupling member positioning portion 306 and a fastening portion 308. The coupling member positioning portion 120, the fastening portion 122, the coupling member positioning portion 306 and the fastening portion 308 are provided for positioning the fixation frame 300.

The coupling member positioning portion 120 is provided on the front surface of the conveyance frame 100, and includes two fitting protruding portions 1200 and 1202 protruded toward the front. The fitting protruding portions 1200 and 1202 are each formed in a substantially cylindrical shape, and arranged in positions separated from each other in the up-and-down direction by a predetermined distance.

The fastening portion 122 is a threaded hole into which a coupling member securing screw (coupling member securing tool) **400*b* for securing the coupling member 400 to the conveyance frame 100. The fastening portion 122 is arranged between the fitting protruding portions 1200 and 1202** in the up-and-down direction.

The coupling member positioning portion 306 is provided on the front surface of the fixation frame 300, and includes two fitting protruding portions 3060 and 3062 protruded toward the front. The fitting protruding portions 3060 and 3062 are each formed in a substantially cylindrical shape, and arranged in positions separated from each other in the up-and-down direction by a predetermined distance.

The fastening portion 308 is a threaded hole into which a coupling member securing screw **400*a* for securing the coupling member 400 to the fixation frame 300 is inserted. The fastening portion 308 is arranged between the fitting protruding portions 3060 and 3062**.

Moreover, the coupling member 400 is provided with a conveyance frame positioning portion 402, a conveyance frame fastening hole 404, a fixation frame positioning portion 406 and a fixation frame fastening hole 408.

The conveyance frame positioning portion 402 is provided in a position corresponding to the coupling member positioning portion 120 of the conveyance frame 100, and includes two fitting holes 4020 and 4022 respectively corresponding to the fitting protruding portions 1200 and 1202. When the fitting protruding portion 1200 is fit into the fitting hole 4020 and the fitting protruding portion 1202 is fit into the fitting hole 4022, the position of the coupling member 400 with respect to the process frame 200 is settled.

The fixation frame positioning portion 406 is provided in a position corresponding to the coupling member positioning portion 306 of the fixation frame 300, and includes two fitting holes 4060 and 4062 respectively corresponding to the fitting protruding portions 3060 and 3062. When the fitting protruding portion 3060 is fit into the fitting hole 4060 and the fitting protruding portion 3062 is fit into the fitting hole 4062, the position of the coupling member 400 with respect to the fixation frame 300 is settled.

The conveyance frame fastening hole 404 is a through hole formed in a position corresponding to the fastening portion 122 of the conveyance frame 100. The fixation frame fastening hole 408 is a through hole formed in a position corresponding to the fastening portion 308 of the fixation frame 300. The coupling member 400 is attached to the conveyance frame 100 when the coupling member securing screw **400*b* is secured to the fastening portion 122 via the conveyance frame fastening hole 404 and the coupling member securing screw 400*a* is secured to the fastening portion 308 via the fixation frame fastening hole 408**.

Moreover, the driving unit 500 includes a drive frame 600, and the drive frame 600 is provided with a fixation frame positioning hole 612, a fixation frame fastening hole 620, a conveyance frame engaging portion 702 and a conveyance frame fastening hole 720.

A fitting protruding portion 312 and a fastening portion 314 are provided on the fixation frame 300 in the rear side. Then, the fixation frame positioning hole 612 formed on the drive frame 600 is a through hole formed in a position corresponding to the fitting protruding portion 312 of the fixation frame 300. When the fitting protruding portion 312 is fit into the fixation frame positioning hole 612, the fixation frame 300 is positioned with respect to the drive frame 600.

The conveyance frame engaging portion 702 of the drive frame 600 is provided in a position corresponding to the driving unit positioning portion 102 provided on the rear surface of the conveyance frame 100. The conveyance frame engaging portion 702 includes two fitting holes 7020 and 7022 respectively corresponding to the fitting protruding portions 1020 and 1022 provided on the conveyance frame 100. When the fitting protruding portions 1020 and 1022 of the conveyance frame 100 are fit into the fitting holes 7020 and 7022 of the drive frame 600, respectively, the position of the drive frame 600 with respect to the conveyance frame 100 is settled. That is, as for the fixation frame 300, the position with respect to the conveyance frame 100 is settled by the drive frame 600.

The fixation frame fastening hole 620 of the drive frame 600 is a through hole formed in a position corresponding to the fastening portion 314 provided in the rear surface of the fixation frame 300. The conveyance frame fastening hole 720 of the drive frame 600 is a through hole formed in a position corresponding to the first fastening portion 108 (see FIG. 5) of the conveyance frame 100.

The drive frame 600 is fastened with the fixation frame 300 when the drive frame securing screw 600*a* is secured to the fastening portion 314 on the rear surface of the fixation frame 300 via the fixation frame fastening hole 620. Then, the drive frame 600 is attached to the conveyance frame 100 when the drive frame securing screw 600*a* is secured to the first fastening portion 108 via the conveyance frame fastening hole 720.

As described above, the fixation frame 300 is positioned and secured to the conveyance frame 100 via the coupling member 400 and the drive frame 600.

Moreover, as shown in FIG. 11, discharge guide portion 300*a* for guiding the sheet passing the fixing nip portion is provided on the fixation frame 300 between the fixing nip portion and the discharge roller 60. Furthermore, the fixing unit guide portion 310 for guiding the fixing unit 46 is provided on the fixation frame 300.

Furthermore, a drive gear 62*a* of the fixing unit 46 is provided in a rear end portion of the fixing unit 46. This drive gear 62*a* is engaged with a drive gear 62*b* (see FIG. 10) provided on the driving unit 500.

Next, with reference to FIG. 10-FIG. 16, structure and attaching structure of the driving unit 500 according to the embodiment will be described.

As shown in FIG. 10-FIG. 14, the driving unit 500 includes a first drive source 502, a feed driving mechanism 510, a first process driving mechanism 512, a fixing driving mechanism 514 and the drive frame 600.

The first drive source 502 is a drive motor for applying rotational driving force to a plurality of rotating bodies provided in the image forming apparatus 10. However, the plurality of rotating bodies correspond to various rollers included in a sheet feeding portion (for example, the feed roller 52, the before transfer feed roller 54, the sheet stop roller 56, a feed roller for manual feed trays and some feed rollers 66 for duplex printing), various rollers included in the image forming portion 30 (for example, the photoreceptor drum 36, a developing roller and a feed screw), various rollers included in the fixing and discharge portion (for example, the heat roller 62, the after fixing feed roller 58 and the discharge roller 60), and so on.

The feed driving mechanism 510 is a mechanism for transmitting the rotational driving force from the first drive source 502 to the various rollers included in the sheet feeding portion. The first process driving mechanism 512 is a mechanism for transmitting the rotational driving force from the first drive source 502 to the various rotating bodies included in the image forming portion 30. The fixing driving mechanism 514 is a mechanism for transmitting the rotational driving force from the first drive source 502 to the various rollers included in the fixing and discharge portion.

However, each of the feed driving mechanism 510, the first process driving mechanism 512 and the fixing driving mechanism 514 is constituted so as to suitably include power transmission elements such as pulleys, belts, gear trains and couplings, as necessary. The same applies to a second process driving mechanism 516 and a third process driving mechanism 518 described later.

Moreover, each of the feed driving mechanism 510, the first process driving mechanism 512 and the fixing driving mechanism 514 includes clutches for selectively transmitting the rotational driving force to the plurality of rotating bodies provided in the image forming apparatus 10. Therefore, each of the plurality of rotating bodies is driven for rotation or stopped, individually.

Next, structure of the drive frame 600 will be described. The drive frame 600 is made of metal, for example, and includes a first support frame 602 arranged in a rear side, and a positioning frame 700 attachably and detachably attached to a front side of the first support frame 602.

The first support frame 602 supports the first drive source 502, the feed driving mechanism 510, the first process driving mechanism 512 and the fixing driving mechanism 514. However, the first drive source 502 is attached to a rear surface of the first support frame 602, and the feed driving mechanism 510, the first process driving mechanism 512 and the fixing driving mechanism 514 are attached to a front surface of the first support frame 602.

Figure 14:
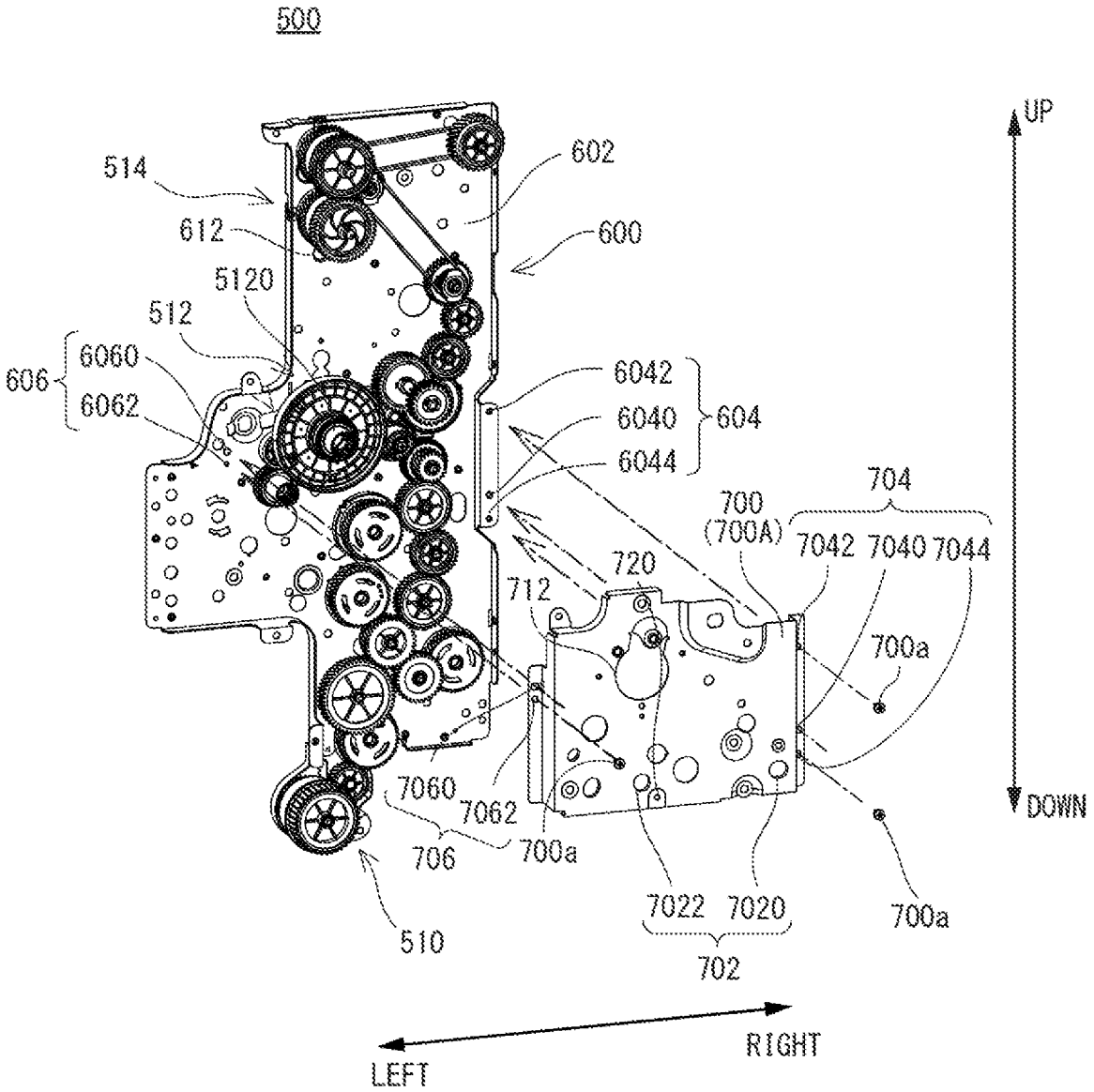
FIG. 14 is a schematic perspective view showing the structure of the driving unit when being partially disassembled.

Moreover, as shown in FIG. 14, the first support frame 602 includes a first positioning/securing portion 604 and a second positioning/securing portion 606, and the above-described fixation frame fastening hole 620 and fixation frame positioning hole 612.

The first positioning/securing portion 604 and the second positioning/securing portion 606 are provided for positioning the first support frame 602 with respect to the positioning frame 700, and are provided outside the feed driving mechanism 510, the first process driving mechanism 512 and the fixing driving mechanism 514 in the left-right direction. Specifically, the first positioning/securing portion 604 is provided in a right end portion of the first support frame 602, and the second positioning/securing portion 606 is provided in a left end portion of the first support frame 602.

The first positioning/securing portion 604 includes a fitting protruding portion 6040 protruded toward the front (toward the positioning frame 700 side), and two threaded holes 6042 and 6044 into which frame securing screws (frame securing tool) 700*a* for securing the positioning frame 700 and the first support frame 602 to each other. The fitting protruding portion 6040 is arranged between the two threaded holes 6042 and 6044.

The second positioning/securing portion 606 includes a fitting protruding portion 6060 protruded toward the front, and a threaded hole 6062 provided near a fitting protruding portion 6060 and into which a frame securing screw 700*a* is secured.

Figure 13:
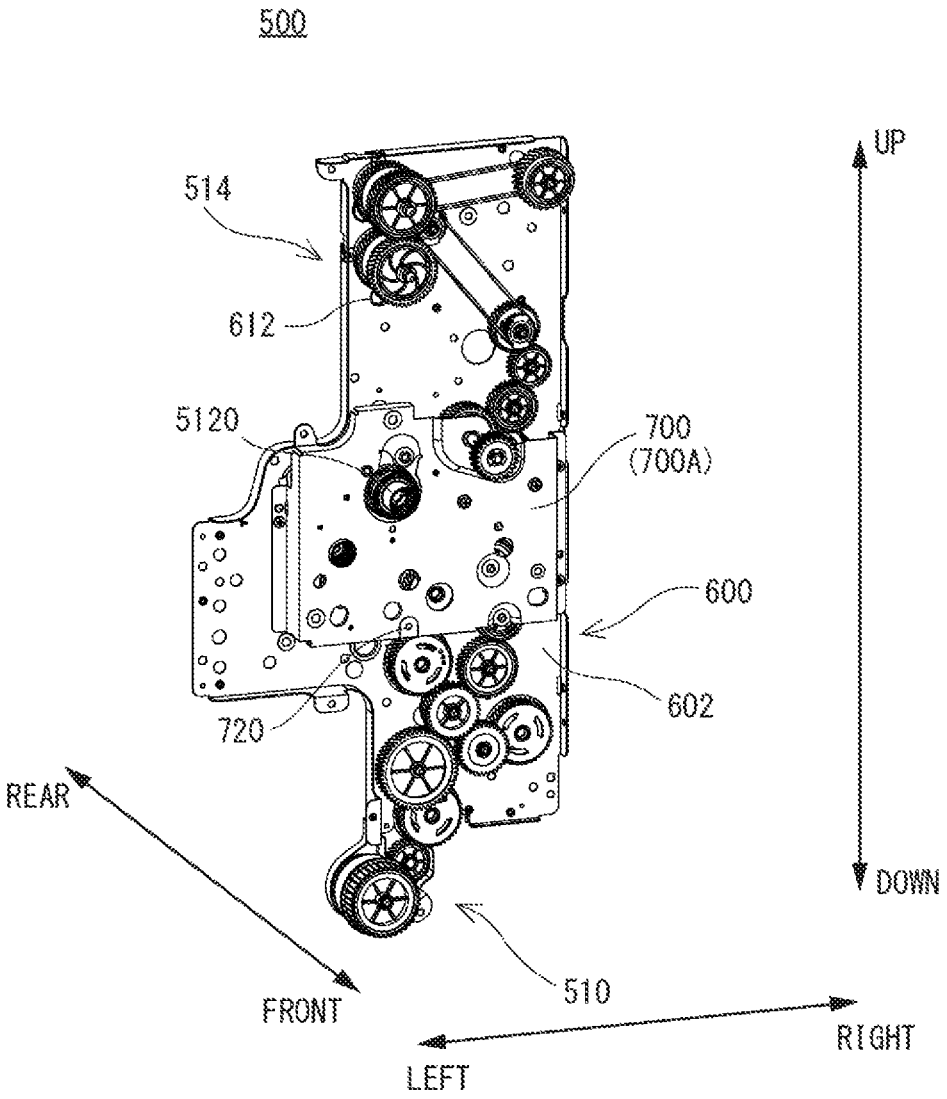
FIG. 13 is a schematic perspective view showing the structure of the driving unit when viewed from another side.

As shown in FIG. 13 and FIG. 14, the positioning frame 700 is provided so as to cover a front side of the first process driving mechanism 512. That is, the first process driving mechanism 512 is accommodated between the first support frame 602 and the positioning frame 700.

Figure 15:
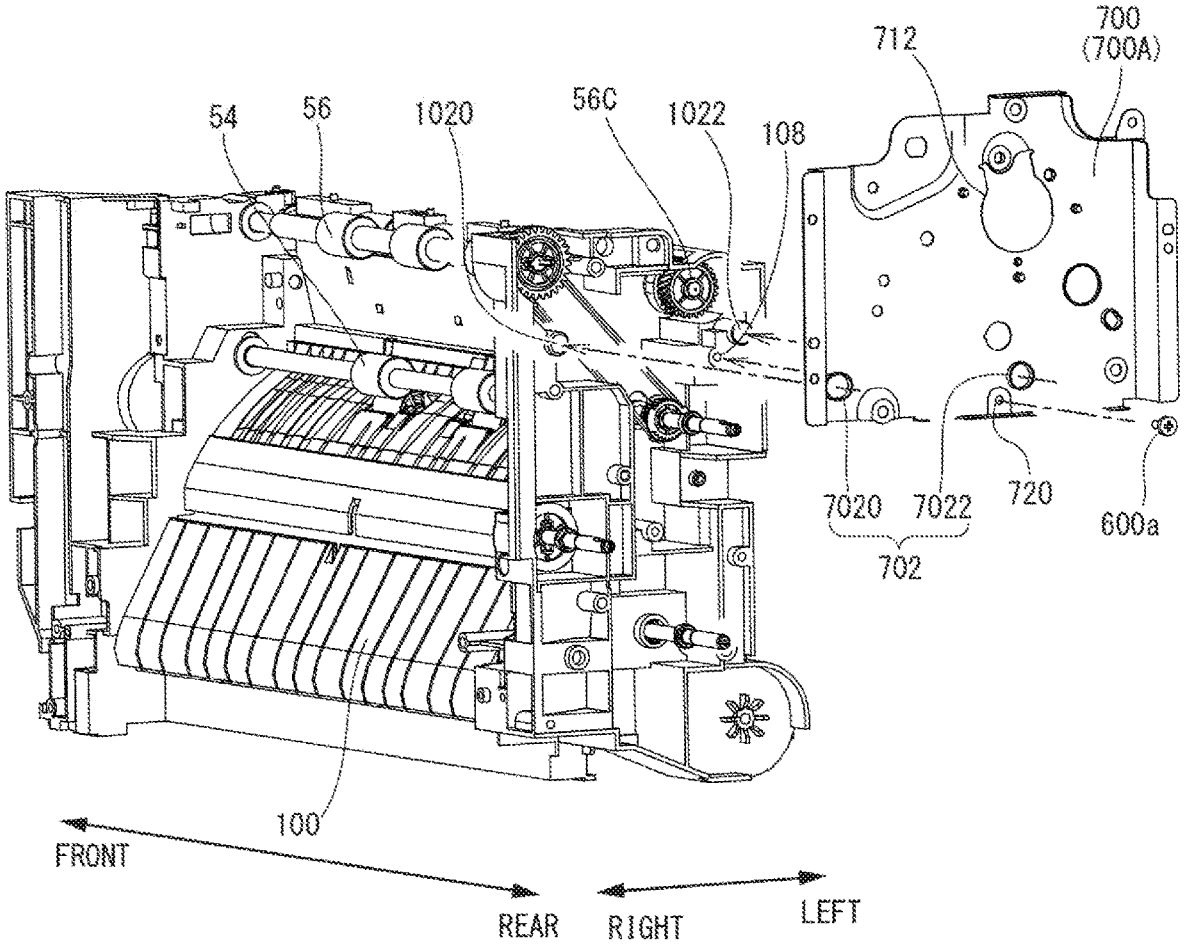
FIG. 15 is a schematic perspective view showing attaching structure of the conveyance frame and a positioning frame.
Figure 16:
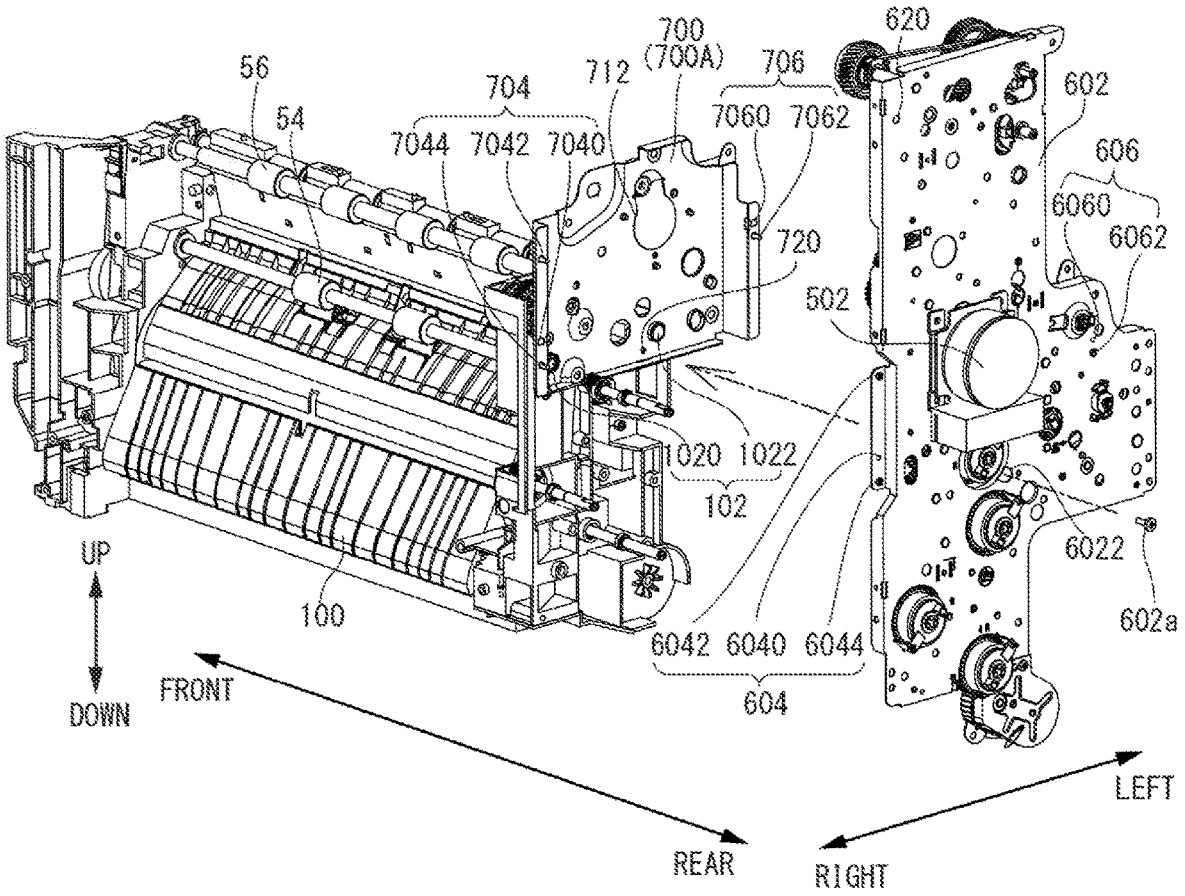
FIG. 16 is a schematic perspective view showing attaching structure of the conveyance frame, and the positioning frame and a first support frame.

Moreover, as shown in FIG. 14-FIG. 16, the positioning frame 700 includes a conveyance frame engaging portion 702, a first positioning/securing portion 704 and a second positioning/securing portion 706.

The conveyance frame engaging portion 702 is provided in a position corresponding to the driving unit positioning portion 102 of the conveyance frame 100, and includes two fitting holes 7020 and 7022 corresponding to the fitting protruding portions 1020 and 1022. As shown in FIG. 15, when the fitting protruding portion 1020 is fit into the fitting hole 7020 and the fitting protruding portion 1022 is fit into the fitting hole 7022, the position of the positioning frame 700 with respect to the conveyance frame 100 is settled. Then, as described above, the conveyance frame engaging portion 702 is attached to the conveyance frame 100 when the drive frame securing screw 600*a* is secured to the first fastening portion 108 via the conveyance frame fastening hole 720. In addition, the fitting hole 7020 has a long hole form.

Returning to FIG. 14, the first positioning/securing portion 704 is provided in a position corresponding to the first positioning/securing portion 604 of the first support frame 602, and includes a fitting hole 7040 corresponding to the fitting protruding portion 6040 and the fastening holes 7042 and 7044 formed in positions corresponding to the two threaded holes 6042 and 6044.

The second positioning/securing portion 706 is provided in a position corresponding to the second positioning/securing portion 606 of the first support frame 602, and includes a fitting hole 7060 corresponding to the fitting protruding portion 6060, and a fastening hole 7062 formed in a position corresponding to the threaded hole 6062.

Then, when the fitting protruding portion 6040 is fit into the fitting hole 7040 and the fitting protruding portion 6060 is fit into the fitting hole 7060, the position of the first support frame 602 with respect to the positioning frame 700 is settled. That is, the first support frame 602 (driving unit 500) is positioned with respect to the conveyance frame 100 via the positioning frame 700.

Moreover, the positioning frame 700 and the first support frame 602 are secured and integrated with each other with the frame securing screw 700*a* that is secured by the threaded holes 6042, 6044 and 6062 via the fastening holes 7042, 7044 and 7062.

Moreover, although illustration is omitted, if the positioning frame 700 is attached to the resin frame 90 (the conveyance frame 100, the process frame 200 and fixation frame 300) in a state being attached to the first support frame 602, the driving mechanisms 510, 512 and 514 are connected to respective ones of the plurality of rotating bodies included in the image forming apparatus 10, so that the rotational driving force from the first drive source 502 can be transmitted to the plurality of rotating bodies. That is, since the first support frame 602 is positioned and secured with respect to the conveyance frame 100, a series of driving mechanisms supported by the first support frame 602 can be arranged along the sheet feeding path with high precision.

As described above, according to this first embodiment, the process frame 200 is positioned with the driving axis of the sheet stop roller 56 attached to the conveyance frame 100 as the reference. Therefore, the process unit 68 (transfer nip portion) to be attached to the process frame 200 can be attached, with high precision, to the position of the sheet stop roller 56 that is attached to the conveyance frame 100.

That is, in the image forming apparatus 10 comprising the resin frame body (frame) divided in the sheet feeding direction, it is possible to ensure the positional precision between the components of the image forming apparatus 10.

Moreover, the image forming apparatus 10 according to the first embodiment includes the front side frame positioning portion 104 that is provided on the conveyance frame 100 and includes the first engaging surface formed in a substantially arc shape and coaxially with a center axis of the sheet stop roller 56, and the rear side frame positioning portion 106, the front side frame positioning portion 204 that is provided on the process frame 200 and includes the second engaging surface engagable with the first engaging surface, and the rear side frame positioning portion 206. Therefore, it is possible to position the process frame 200 appropriately with respect to the conveyance frame 100, and to ensure the positional precision between the components of the image forming apparatus 10.

Furthermore, since the fixation frame 300 is positioned and secured to the conveyance frame 100 via the coupling member 400 and the drive frame 600, it is possible to ensure the positional precision between the components of the image forming apparatus 10. In other words, the positional precision between the components of the image forming apparatus 10 attached to the fixation frame 300 and the conveyance frame 100 can be ensured.

Summarizing the above, according to the first embodiment, the process frame 200, the fixation frame 300, the connecting member 400 and the driving unit 500 are all positioned with respect to the conveyance frame 100, it is possible to ensure the positional precision of various components provided in the image forming apparatus 10. That is, it is possible to arrange various components provided in the image forming apparatus 10 with high precision so as to form a sheet feeding path with the conveyance frame 100 as the reference. In other words, even if the configuration that the resin frame body (frame) is divided in the sheet feeding direction is adopted, it is possible to arrange various components provided in the image forming apparatus 10 along the sheet feeding path with high precision.

In addition, according to the first embodiment, since the conveyance frame 100, the process frame 200 and the fixation frame 300 are formed with different kinds of resin materials, respectively, it is possible to select the optimal material according to the properties of each frame. Therefore, it is not necessary to use an expensive material even in a portion other than the portion where the positional precision is required or the heat resistance is required, and as a result, the manufacturing cost can be reduced. Moreover, it is needles say that by dividing the resin frame body (frame), each molding die can be downsized, and therefore, a cost of mold production can be minimized and a period of mold production can be shortened.

In addition, as structure different from those of the above-described embodiment, the conveyance frame 100 and the fixation frame 300 may be brought into contact with each other directly. In the following, with reference to FIG. 17, structure of the resin frame 90 in a modified example (FIG. 17 embodiment) will be described.

Figure 17:
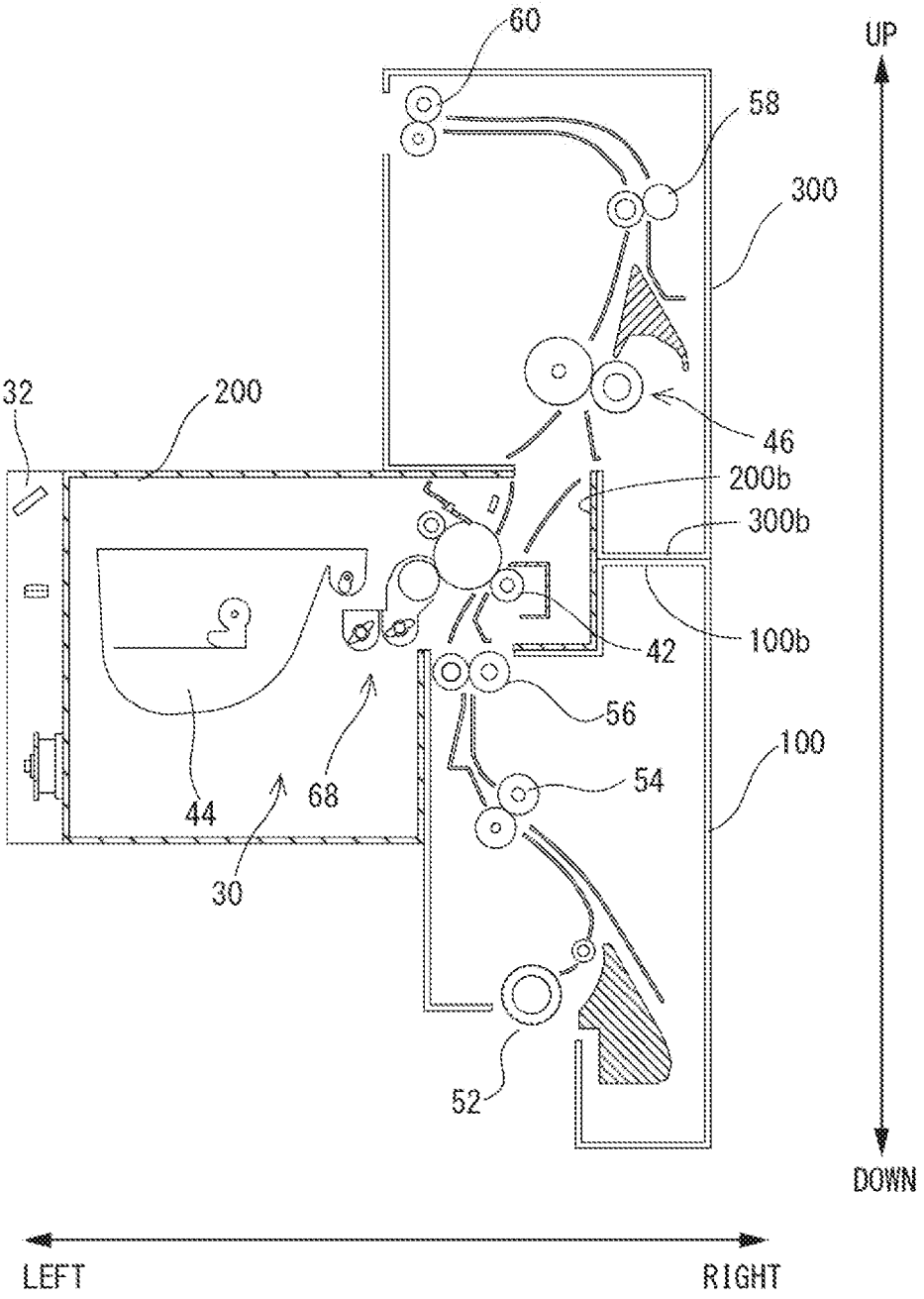
FIG. 17 is an illustration view showing structure of the resin frame in a modified example.

As shown in FIG. 17, in the FIG. 17 embodiment, the right end portion 200*b* of the process frame 200 is rendered to be located in the left compared with the right end portion of the housing 12 (resin frame 90). With such a configuration, a space that spreads in the up-and-down direction will be ensured in the right of the process frame 200. Then, by utilizing this space, a protruding portion 100*b* protruded upwardly from an upper end portion of the conveyance frame 100 is formed on the conveyance frame 100, and a protruding portion 300*b* protruded downwardly from a lower end portion of the fixation frame 300 is formed on the fixation frame 300.

Then, if an upper surface of the protruding portion 100*b* of the conveyance frame 100 and a lower surface of the protruding portion 300*b* of the fixation frame 300 are brought into contact with each other, it is possible to determine the position of the conveyance frame 100 and the fixation frame 300 in the up-and-down direction. Therefore, since the coupling member 400 is dispensable in the FIG. 17 embodiment, it is possible to reduce the number of components and thus a manufacturing cost.

Second Embodiment

An image forming apparatus 10 according to the second embodiment is the same as the image forming apparatus 10 according to the first embodiment except for positioning structure of the image forming portion 30 (process unit 68), and therefore, in the following, different structure will be described to omit duplicate description. In the second embodiment, positioning of a rear end (driving unit 500 side) of the process unit 68 is performed by a positioning frame 700 to which the driving unit 500 is attached. Therefore, the process frame 200 does not comprise the rear side process positioning portion 212, and a through hole for avoiding a bearing guide portion 7100 of a bearing guide member 710 described later is formed in the rear surface of the process frame 200, instead of the rear side process positioning portion 212. (Not illustrated)

In the following, with reference to FIG. 18 and FIG. 19, structure of the positioning frame 700, and positioning structure of the process unit 68 by the positioning frame 700 will be described.

Figure 18:
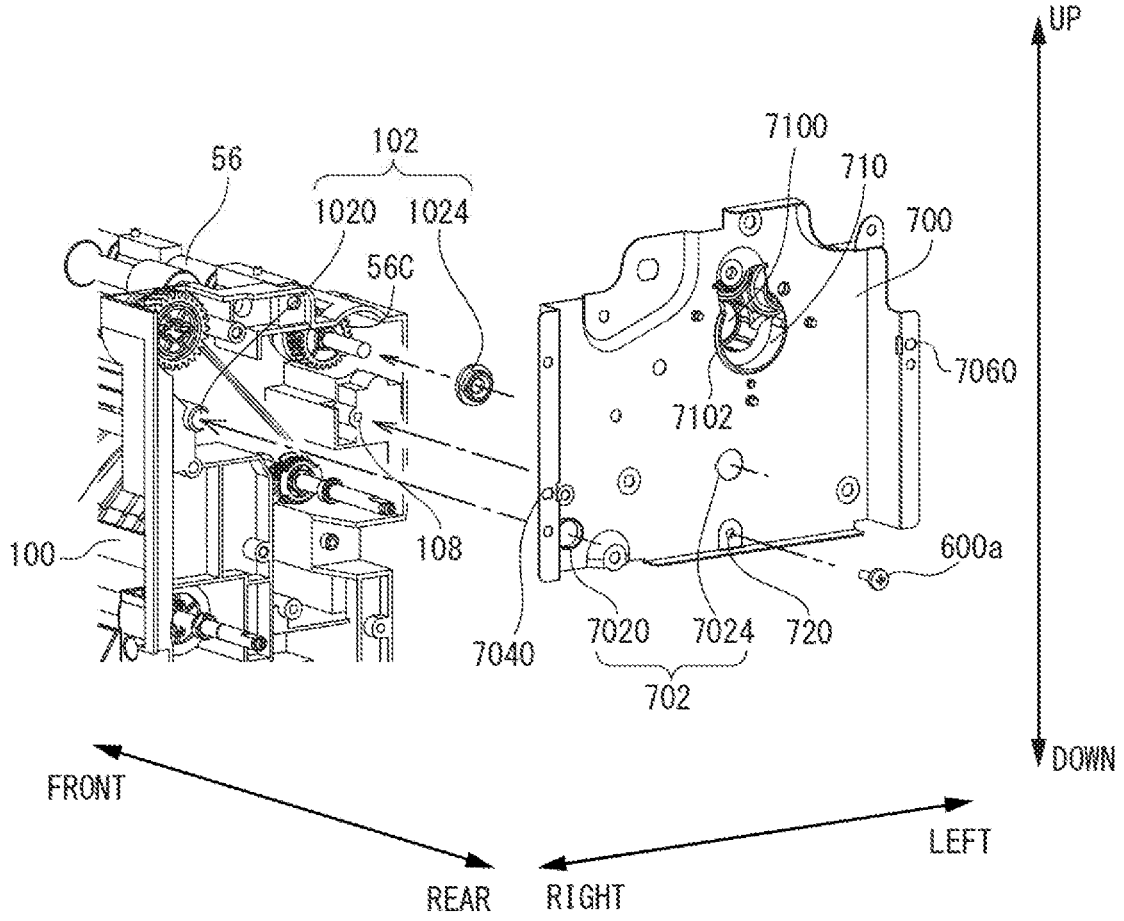
FIG. 18 is a schematic perspective view showing positioning structure of the conveyance frame and the position frame in the modified example.
Figure 19:
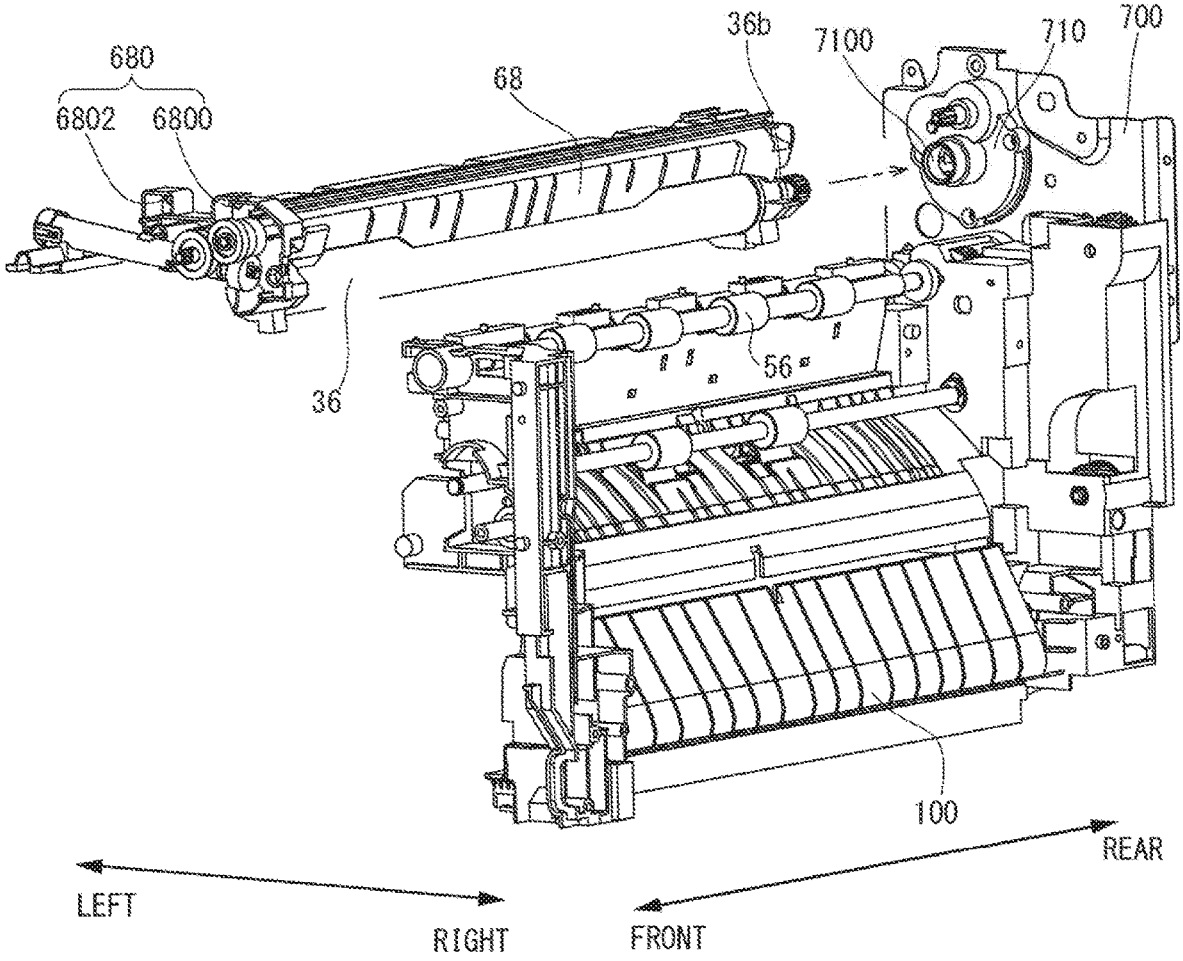
FIG. 19 is a schematic perspective view showing positioning structure of the process unit in the second embodiment.

As shown in FIG. 18 and FIG. 19, the bearing guide member 710 that defines an attaching position in the rear surface side of the process unit 68 is attached to the front surface of the positioning frame 700. The bearing guide member 710 is attached to the front side of an opening portion 712 formed in the positioning frame 700. The bearing guide member 710 has the bearing guide portion 7100 that is protruded forwardly and has a cylindrical guide portion inside thereof and an attachment guide portion 7102 that is engaged with the opening portion 712 of the positioning frame 700, the cylindrical guide portion being engaged with the bearing 36*b* of the process unit 68.

The bearing guide portion 7100 is set such that an inner diameter of the cylindrical guide portion is slightly larger than an outer diameter of the bearing 36*b* of the photoreceptor drum 36. The attachment guide portion 7102 is a wall-shaped guide that is extended toward the positioning frame 700 side from a main body of the bearing guide member 710 along an inner edge of the opening portion 712 of the positioning frame 700. Then, when the attachment guide portion 7102 and the opening portion 712 are engaged with each other, an attaching position of the bearing guide member 710 with respect to the positioning frame 700 is settled, thereby to be secured to the positioning frame 700 by a fastening member such as a screw.

Next, positioning structure of the positioning frame 700 with respect to the conveyance frame 100 will be described.

As shown in FIG. 18, in the second embodiment, a driving unit positioning portion 102 (corresponding to the positioning portion of the positioning frame 700 attached to the driving unit 500) provided in the conveyance frame 100 includes a bearing 1024 attached to the rotation axis, specifically the driving axis of the sheet stop roller 56, instead of the fitting protruding portion 1022.

Moreover, in the second embodiment, instead of the fitting hole 7022 corresponding to the fitting protruding portion 1022, the conveyance frame engaging portion 702 provided in the positioning frame 700 includes a fitting hole 7024 formed coaxially with the bearing 1024 (driving axis of the sheet stop roller 56). Therefore, when the fitting protruding portion 1020 is fit into the fitting hole 7020 and the fitting hole 7024 is fit with the bearing 1024, the position of the positioning frame 700 with respect to the conveyance frame 100 is settled. In this case, since the fitting hole 7020 is a long hole, a combination of the fitting hole 7024 and the bearing 1024 serves the reference and a combination of the fitting protruding portion 1020 and the fitting hole 7020 serves as a rotation stopper. That is, the positioning frame 700 is positioned with being centered by the rotation axis, specifically the driving axis of the sheet stop roller 56.

Next, with reference to FIG. 19, positioning structure of the process unit 68 in the second embodiment will be described. As shown in FIG. 19, in the second embodiment, when the bearing 36*b* of the photoreceptor drum 36 is fit into the bearing guide portion 7100 of the bearing guide member 710 attached to the positioning frame 700, the position of the rear end portion of the process unit 68 with respect to the process frame 200 is settled. That is, the bearing guide member 710 functions as a member (attachment positioning member) for positioning the process unit 68 (image forming portion 30), and the bearing guide portion 7100 functions as an attachment positioning portion of the process unit 68.

In addition, since it is the same as the first embodiment about the positioning structure of the front end portion of the process unit 68 to the process frame 200, description is omitted.

As described above, since the bearing guide member 710 is arranged with respect to the rotation axis (specifically, driving axis) of the sheet stop roller 56 with high precision, it is possible to arrange with high precision the photoreceptor drum 36 with respect to the sheet stop roller 56 in a predetermined positional relationship. That is, since the position of the photoreceptor drum 36 with respect to the sheet stop roller 56 can be controlled with high precision even if resin frame 90 is divided into the conveyance frame 100 and the process frame 200 in the sheet feeding direction, it becomes possible to stably perform the sheet feed from the sheet stop roller 56 to the transfer position of the photoreceptor drum 36 with high precision. In addition, in FIG. 19, in order to make attaching structure of the process unit 68 intelligible, the process frame 200 is not illustrated.

In addition, the positioning frame 700 may be made of metal so that the position of the photosensitive drum 36 with respect to the sheet stop roller 56 can be stably controlled by reducing the influence of changes over time.

Moreover, although the bearing guide member 710 is made of resin in the second embodiment, the bearing guide member 710 may be formed integrally with the positioning frame 700 made of metal, or the positioning frame 700 may be made of resin to be integrally formed with the bearing guide member 710.

Furthermore, since the process unit 68 is positioned by the positioning frame 700, the rear side frame positioning portion 206 of the process frame 200 described in the first embodiment is dispensable.

As described above, in the second embodiment, the process unit 68 is positioned with respect to the bearing guide member 710 provided on the positioning frame 700 that is positioned with respect to the conveyance frame 100, not with respect to the rear side process positioning portion 212 provided in the process frame 200. The positioning frame 700 is positioned with the conveyance frame 100 and thus with the rotation axis, specifically the driving axis of the sheet stop roller 56 provided in the conveyance frame 100, as the reference. That is, a member provided with the positioning portion for positioning the process unit 68 is a smaller positioning frame 700 rather than a larger process frame 200. The smaller the member is, the easier it is to obtain dimensional precision, so that the process unit 68 can be arranged more precisely with respect to the sheet stop roller 56. Moreover, by making the positioning frame 700 made of metal, the positions of the process unit 68 and the sheet stop roller 56 can be stably and precisely controlled. It becomes more difficult to be affected by thermal expansion and deformation and strain due to aging.

That is, according to this second embodiment, in the image forming apparatus including a plurality of resin frame bodies divided in the sheet feeding direction, the positional precision between the components of the image forming apparatus 10, especially, the positional precision of the process unit 68 (transfer nip portion) with respect to the sheet stop roller 56 can be further improved.

Moreover, instead of the structure described in the above-described second embodiment, the conveyance frame 100 may be provided with a feed drive frame 550 comprising a drive portion for the feed roller 54, etc., whereby the positioning frame 700 is positioned and secured to the conveyance frame 100 via the feed drive frame 550.

In the following, with reference to FIG. 20 and FIG. 21, structure of the feed drive frame 550 in a modified example (FIG. 20 embodiment) and attaching structure to the conveyance frame 100 of the positioning frame 700 will be described.

Figure 20:
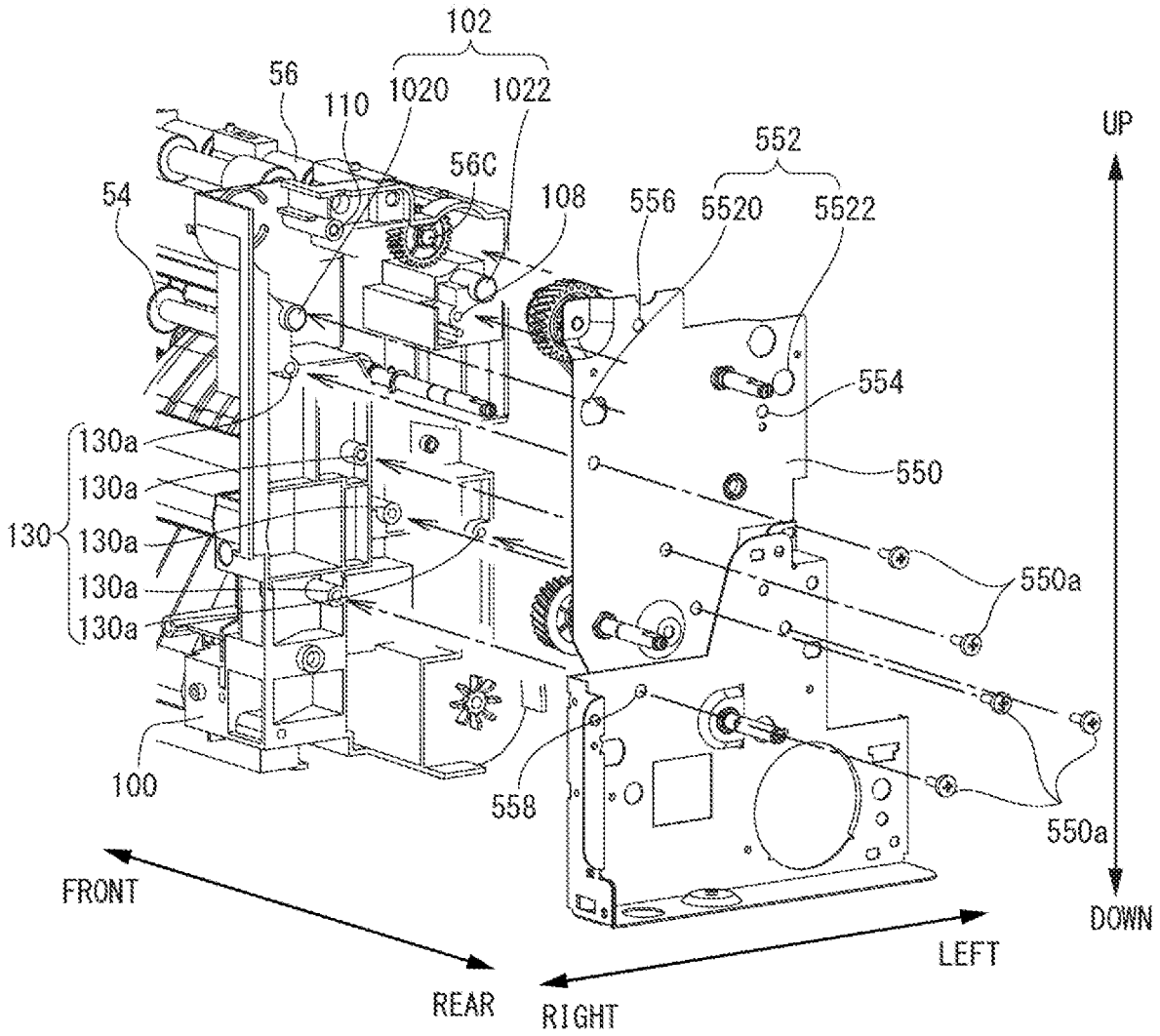
FIG. 20 is a schematic perspective view showing attaching structure of the conveyance frame and a conveying drive frame in a modified example.
Figure 21:
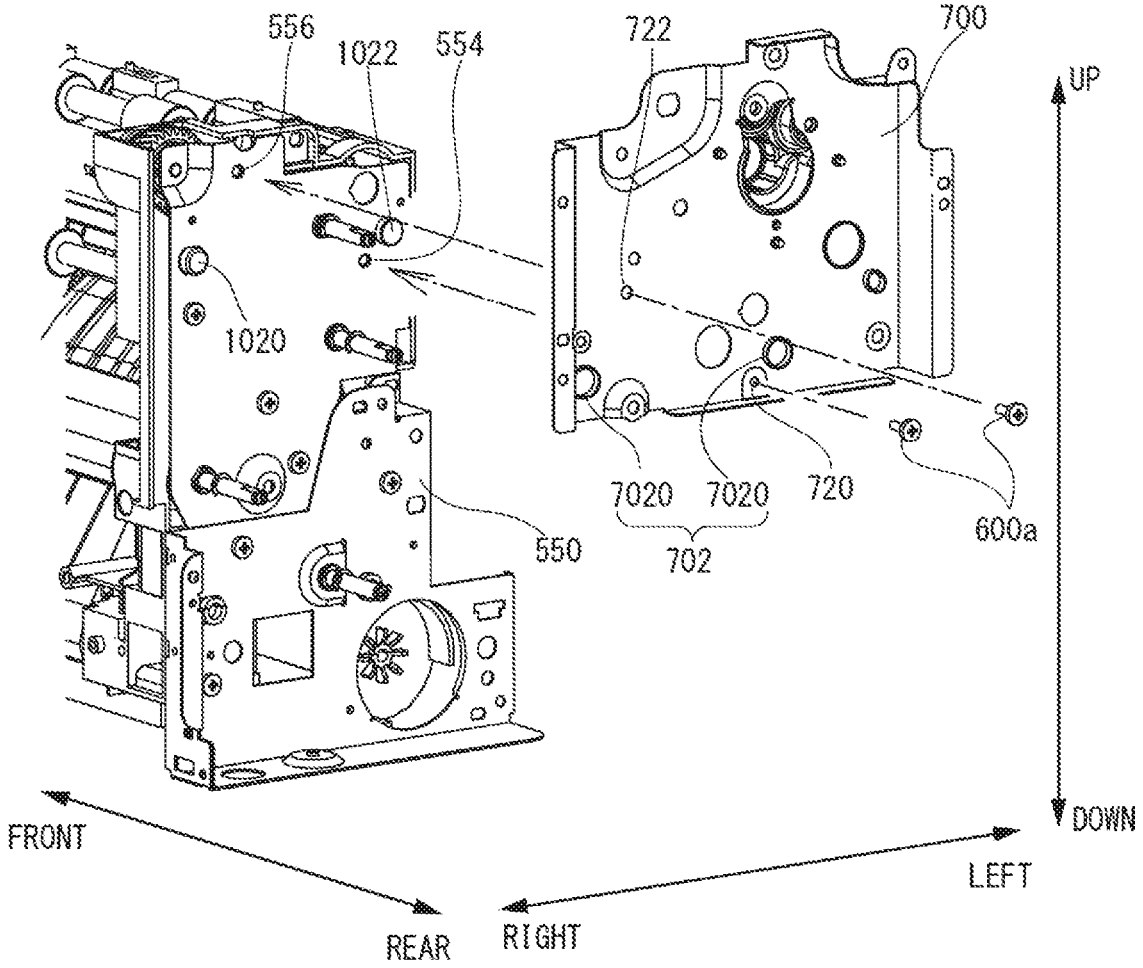
FIG. 21 is a schematic perspective view showing attaching structure of the positioning frame to the conveyance frame and the feeding drive frame in FIG. 18 embodiment.

As shown in FIG. 20 and FIG. 21, the conveyance frame 100 has the feed drive frame 550 made of metal, which supports the drive portions such as rotation axes of the sheet stop roller 56, the feed roller 54, etc. and gears together with the conveyance frame 100. Moreover, the feed drive frame 550 is provided with a mechanism that transmits the rotational driving force from the first drive source 502 to the sheet stop roller 56 and the feed roller 54, etc. That is, a portion of the feed driving mechanism 510 is included. The feed drive frame 550 includes a feed drive positioning portion 552, a first fastening hole 554, a second fastening hole 556 and a plurality of third fastening holes 558.

The feed drive positioning portion 552 is provided in a position corresponding to the driving unit positioning portion 102 of the conveyance frame 100, and includes two fitting holes 5520 and 5522 corresponding to the fitting protruding portion 1020 and 1022, respectively. When the fitting protruding portion 1020 is fit into the fitting hole 5520 and the fitting protruding portion 1022 is fit into the fitting hole 5522, the position of the feed drive frame 550 with respect to the conveyance frame 100 is settled.

The first fastening hole 554 is formed in a position corresponding to the first fastening portion 108 of the conveyance frame 100. Moreover, in the FIG. 20 embodiment, a second fastening portion 110 different from the first fastening portion 108 is provided on the rear surface of the conveyance frame 100. The second fastening hole 556 is formed in a position corresponding to this second fastening portion 110.

Furthermore, in the FIG. 20 embodiment, a feed drive frame fastening portion 130 for securing the feed drive frame 550 to the conveyance frame 100 is provided in the conveyance frame 100. The feed drive frame fastening portion 130 is provided on the rear surface of the conveyance frame 100, and includes a plurality of threaded holes **130*a* into which feed drive frame screws 550*a* (feed drive securing tool) are inserted. Then, a plurality of third fastening holes 558 are formed in positions respectively corresponding to the plurality of threaded holes 130*a***.

The feed drive frame 550 is attached to the conveyance frame 100 by the plurality of feed drive frame screws **550*a* secured into the plurality of threaded holes 130*a* via the plurality of third fastening holes 558. The resin-made conveyance frame 100 has strength (rigidity) increased by integrally fastened with the metal-made feed drive frame 550**, and thus, the resistance to bending and deformation is improved.

Moreover, as shown in FIG. 21, in the FIG. 20 embodiment, a conveyance frame fastening hole 722 is formed in the positioning frame 700 separately from the conveyance frame fastening hole 720. The conveyance frame fastening hole 722 is formed in a position corresponding to both of the second fastening portion 110 of the conveyance frame 100 and the second fastening hole 556 of the feed drive frame 550.

When the drive frame securing screw **600*a* is secured to the first fastening portion 108 via the conveyance frame fastening hole 720 and the first fastening hole 554 and the drive frame securing screw 600*a* is secured to the second fastening portion 110 via the conveyance frame fastening hole 722 and the second fastening hole 554, the drive frame 600 (positioning frame 700) is attached to the conveyance frame (more firmly). That is, in the FIG. 20 embodiment, the drive frame 600 (positioning frame 700) is attached to the conveyance frame 100 via the feed drive frame 550**.

In addition, although a case where the positioning frame 700 and the feed drive frame 550 are fastened together with the conveyance frame 100 is described in FIG. 21 as an example, it does not need to be limited to this. For example, the positioning frame 700 and the feed drive frame 550 may be secured to each other with a screw etc., and separately, the feed drive frame 550 and the conveyance frame 100 may be secured to each other with a screw etc. Even in this case, the positioning frame 700 is attached to the conveyance frame 100 via the feed drive frame 550. Moreover, since it is possible to stably attach the positioning frame 700 to the conveyance frame 100 by the feed drive frame 550 with high precision, the fitting hole 7024 that is fit with the bearing 1024 of the sheet stop roller 56 is dispensable.

As described above, according to the FIG. 20 embodiment, since the feed drive frame 550 is attached to the conveyance frame 100, it is possible to increase strength of the conveyance frame 100, and the conveyance frame 100 is resistant to bending, warpage, etc. due to external pressure and changes with time, and the posture of the conveyance frame 100 can be stabilized. Therefore, the positional precision of respective components supported by the conveyance frame 100 is ensurable.

That is, according to this FIG. 20 embodiment, in an image forming apparatus including a plurality of resin frame bodies divided in the sheet feeding direction, the positional precision between the components of the image forming apparatus 10 can be further increased.

Third Embodiment

An image forming apparatus 10 according to the third embodiment is the same as the image forming apparatus 10 according to the first embodiment except that the former is configured to selectively comprises resin frames having different specifications and a driving unit having different specification, and therefore, the configuration that differs from those of the first embodiment will be described to omit duplicate description.

Figure 22:
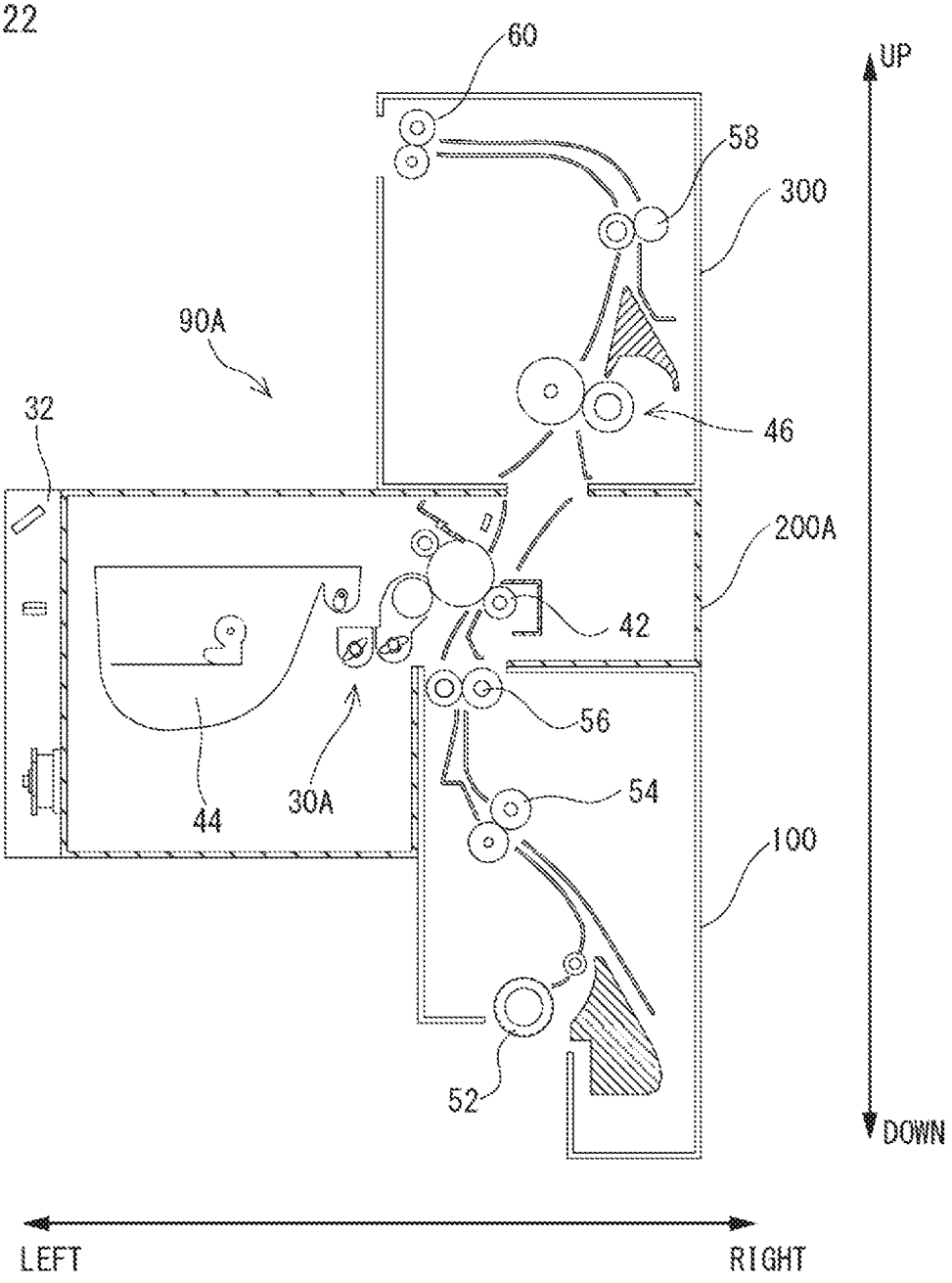
FIG. 22 is an illustration view showing structure of a resin frame for monochrome in a third embodiment.
Figure 23:
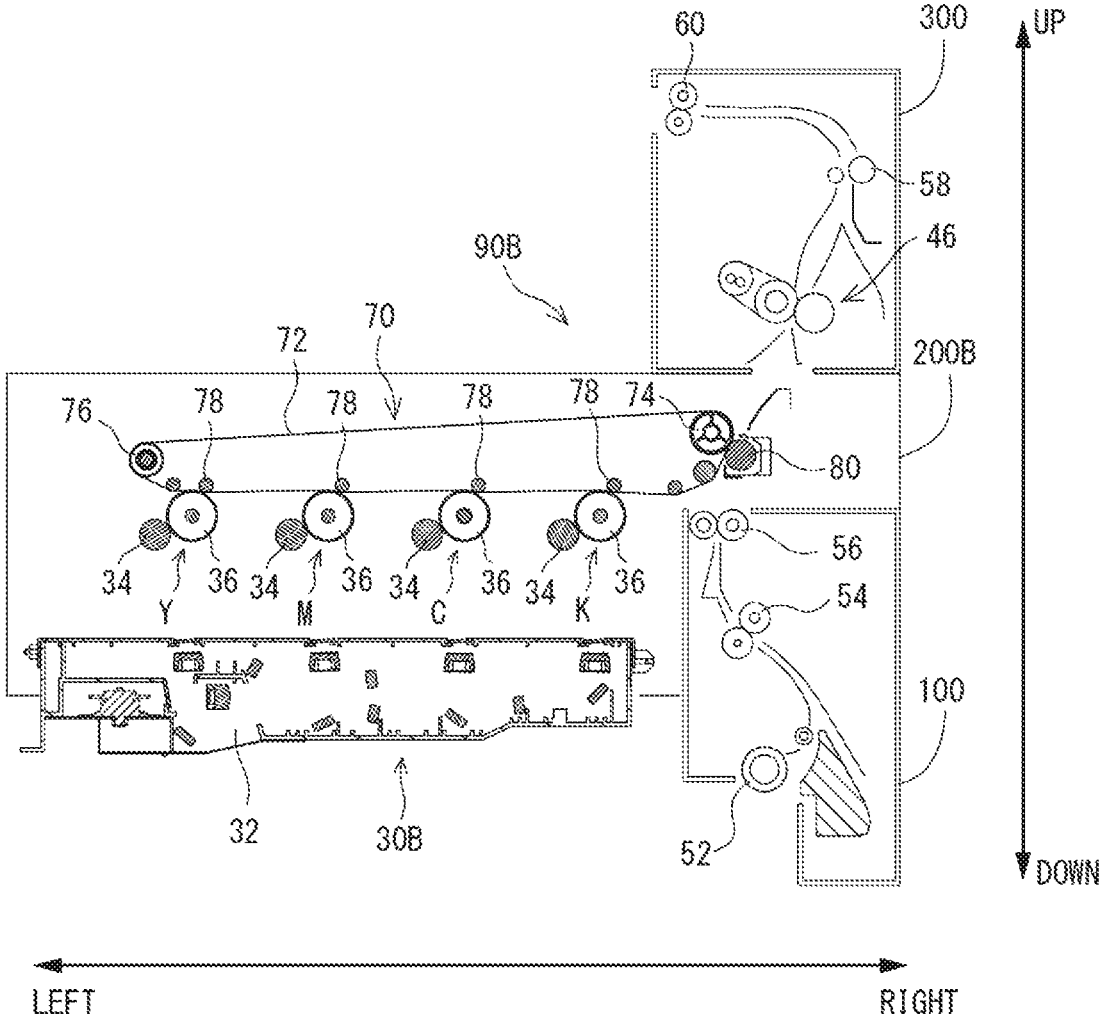
FIG. 23 is an illustration view showing structure of a resin frame for color in the third embodiment.

As shown in FIG. 22 and FIG. 23, the image forming apparatus 10 of the third embodiment selectively comprises one of a resin frame for monochrome 90A and a resin frame for color 90B. The resin frame for monochrome 90A includes a process frame for monochrome 200A that supports an image forming portion for monochrome 30A, and the resin frame for color 90B includes a process frame for color 200B that supports an image forming portion for color 30B.

However, since a configuration of the resin frame for monochrome 90A is the same as that of the resin frame 90 described in the first embodiment, and a configuration of the image forming portion for monochrome 30A is the same as that of the image forming portion 30 described in the first embodiment, description on them will be omitted.

In the following, with reference to FIG. 23, schematic structure of the image forming portion for color 30B will be described. As shown in FIG. 23, the image forming portion for color 30 comprises an exposure unit 32, a developing unit 34, a photoreceptor drum 36, a cleaner unit 38, a electrostatic charging unit 40, a toner resupply device 44, an intermediate transfer belt unit 70, a transfer roller 80 (secondary transfer roller), etc. In addition, in FIG. 23, illustration of the cleaner unit 38, the electrostatic charging unit 40 and the toner resupply apparatus 44 is omitted.

For example, image data treated in the image forming portion for color 30B corresponds to color images of four colors, black (K), a cyan (C), magenta (M) and yellow (Y). Therefore, the developing unit 34, the photoreceptor drum 36, the cleaner unit 38 and the electrostatic charging unit 40 are respectively provided by four (4) so that four (4) kinds of latent images corresponding to respective colors can be formed, and four (4) image stations are constituted by these components. The four (4) image stations are arranged in a line in the horizontal direction along a running direction (left-right direction) of a surface of the intermediate transfer belt 72.

The intermediate transfer belt unit 70 comprises an intermediate transfer belt 72, a drive roller 74, a driven roller 76, four (4) intermediate transfer rollers 78, etc. The intermediate transcribe belt 72 is arranged above the photoreceptor drums 36 of four (4) image stations so as to be brought into contact with each of the photoreceptor drums 36. Then, a multicolor toner image is formed on the intermediate transfer belt 72 by sequentially transferring, with using the intermediate transfer rollers 78, each color toner image that is formed on each photoreceptor drum 36 onto the intermediate transfer belt 72 in an overlapping manner. Moreover, the secondary transfer roller 80 is arranged in a position facing the drive roller 74 via the intermediate transfer belt 74, and when a sheet passes through a nip region (secondary transfer nip portion) between the intermediate transfer belt 72 and the secondary transfer roller 80, the toner image formed on the intermediate transfer belt 72 is transferred onto the sheet.

Respective components of the image forming portion for color 30B are supported by the process frame for color 200B.

Figure 24:
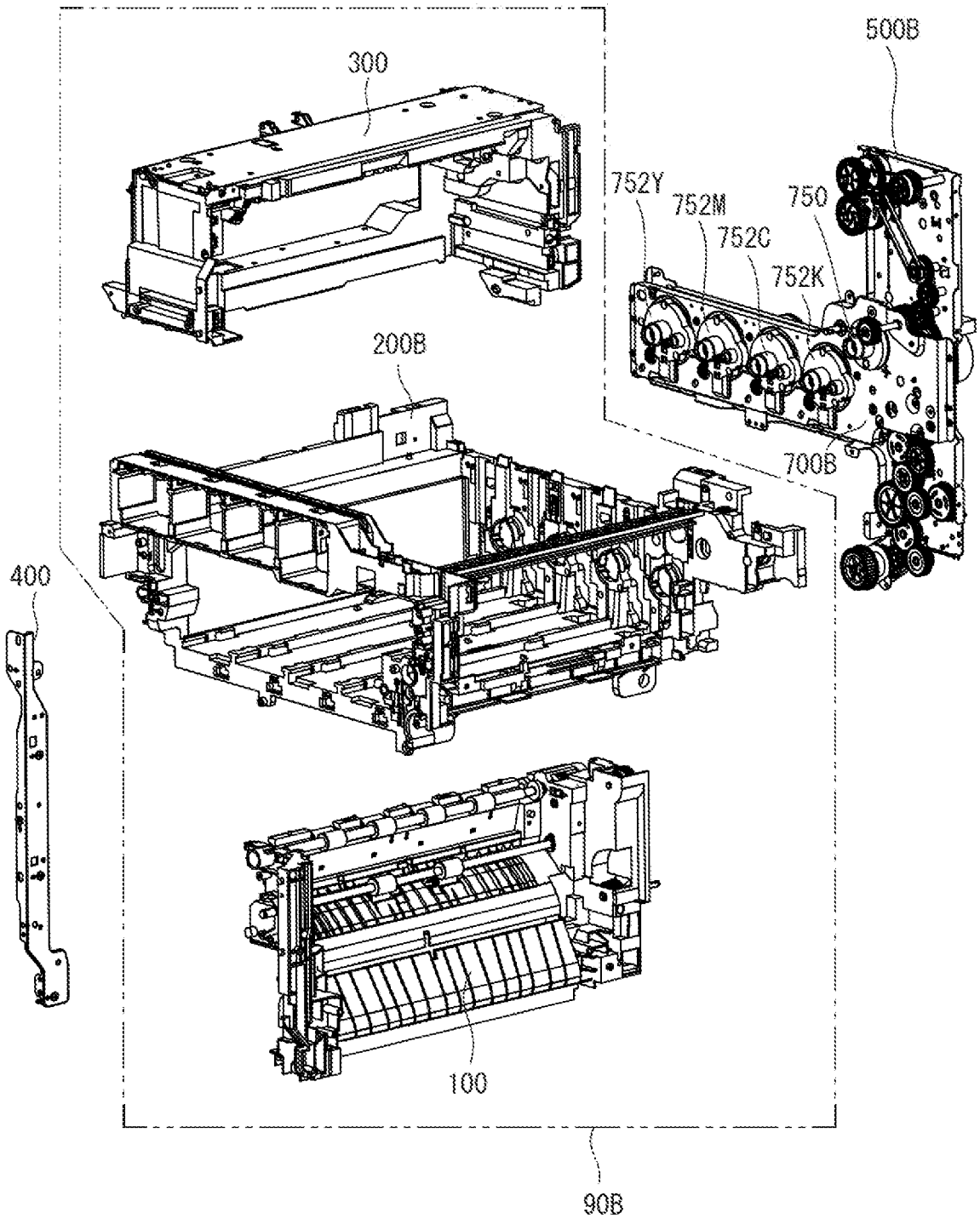
FIG. 24 is a schematic perspective view showing the resin frame for color and a coupling member attached thereto.

Next, with reference to FIG. 23 and FIG. 24, schematic structure of the resin frame for color 90B will be described. As shown in FIG. 23 and FIG. 24, the resin frame for color 90B includes a conveyance frame 100, a process frame for color 200B and a fixation frame 300.

In addition, the resin frame for monochrome 90A and the resin frame for color 90B differ from each other only in a shape of the process frame 200. Therefore, for the resin frame for color 90B, it is possible to use (commonly use) the same conveyance frame 100 and the same fixation frame 300 as those of the resin frame for monochrome 90A.

Furthermore, the process frame for monochrome 200A and the process frame for color 200B are the same in the structure of the front side frame positioning portion 204, the rear side frame positioning portion 206, the front side guide portion 220 and the rear side guide portion 222.

Therefore, in also the resin frame for color 90B, the positioning and attaching structure of the conveyance frame 100 and the process frame for color 200B, the positioning and attaching structure of the process frame for color 200B and the fixation frame 300, and the positioning and attaching structure of the conveyance frame 100 and the fixation frame 300 are the same as those of the first embodiment, and therefore, description on them will be omitted. Moreover, for the resin frame for color 90B, it is possible to use the same coupling member 400 for positioning between the conveyance frame 100 and the fixation frame 300 as that of the resin frame for monochrome 90A.

However, when the resin frame for color 90B (image forming portion for color 30B) is adopted, as for the driving unit 500, instead of the driving unit for monochrome 500A (the same as the driving unit 500 of the first embodiment), a driving unit for color 500B is used. In addition, since FIG. 24 shows what applies the second embodiment to the form for color, each component of the image forming portion for color 30B is supported by not the process frame for color 200B but the positioning frame for color 700B. Moreover, the driving unit for color 500B is positioned and secured by the positioning frame for color 700B. Since the positioning and attaching structure of the positioning frame for color 700B to the conveyance frame 100 is the same as those of the second embodiment, description thereof is omitted. Moreover, although the positioning frame for color 700B is different from the positioning frame for monochrome 700A in a point that the former comprises a plurality of bearing guide members 752K, 752C, 752M, 752Y and 750 in order to support a plurality of process units 68 and the intermediate transfer belt unit (specifically, drive rollers for the intermediate transfer belt), only the number of bearing guide members differs, and obtainable effect is not different from those described in the second embodiment.

In the following, with reference to FIG. 25, FIG. 26, FIG. 27, FIG. 28A and FIG. 28B, specific structure of the driving unit for color 500B will be described.

Figure 25:
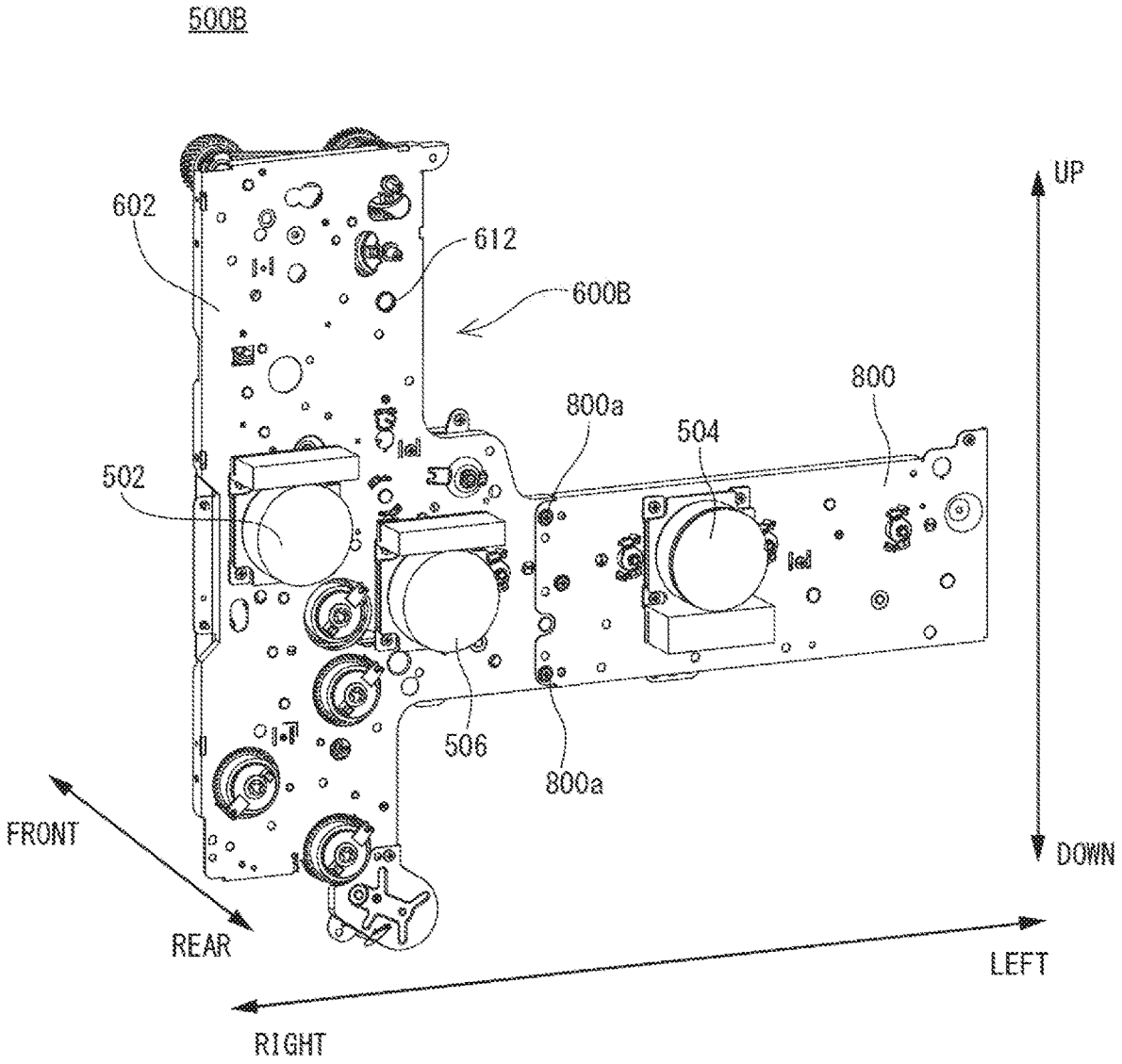
FIG. 25 is a schematic perspective view showing structure of a driving unit for color when viewed from one side.
Figure 26:
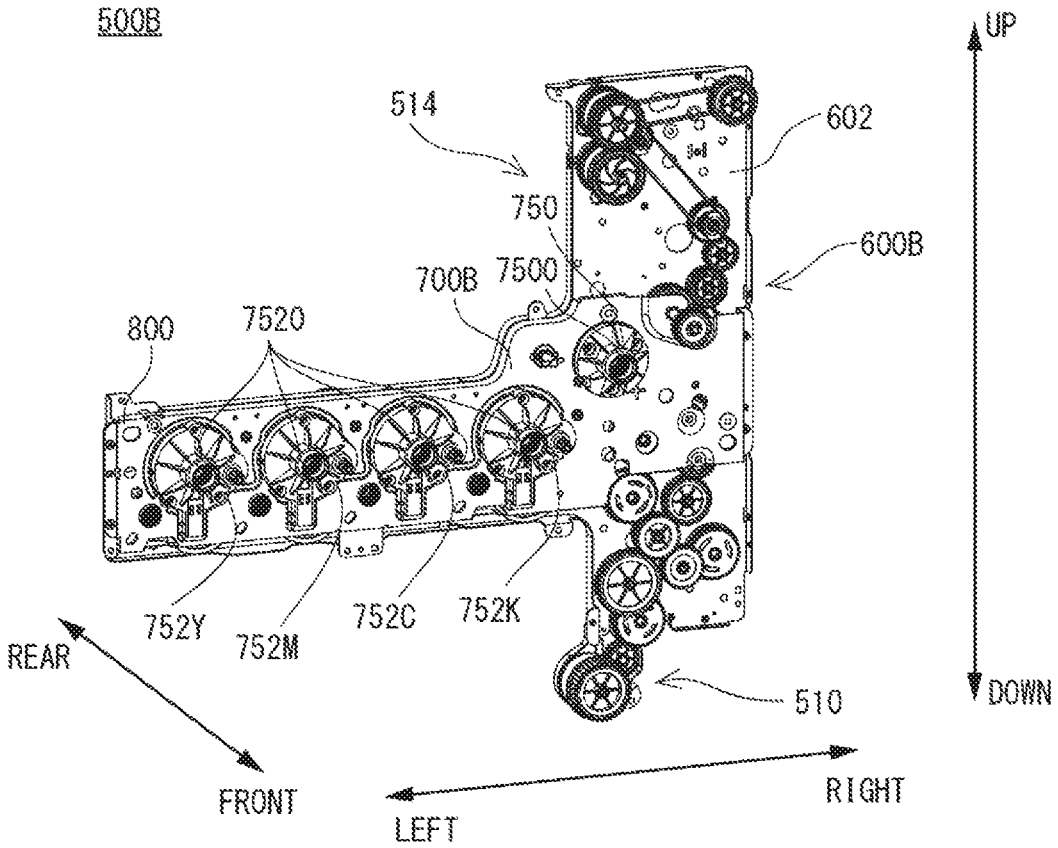
FIG. 26 is a schematic perspective view showing the structure of the driving unit for color when viewed from another side.
Figure 27:
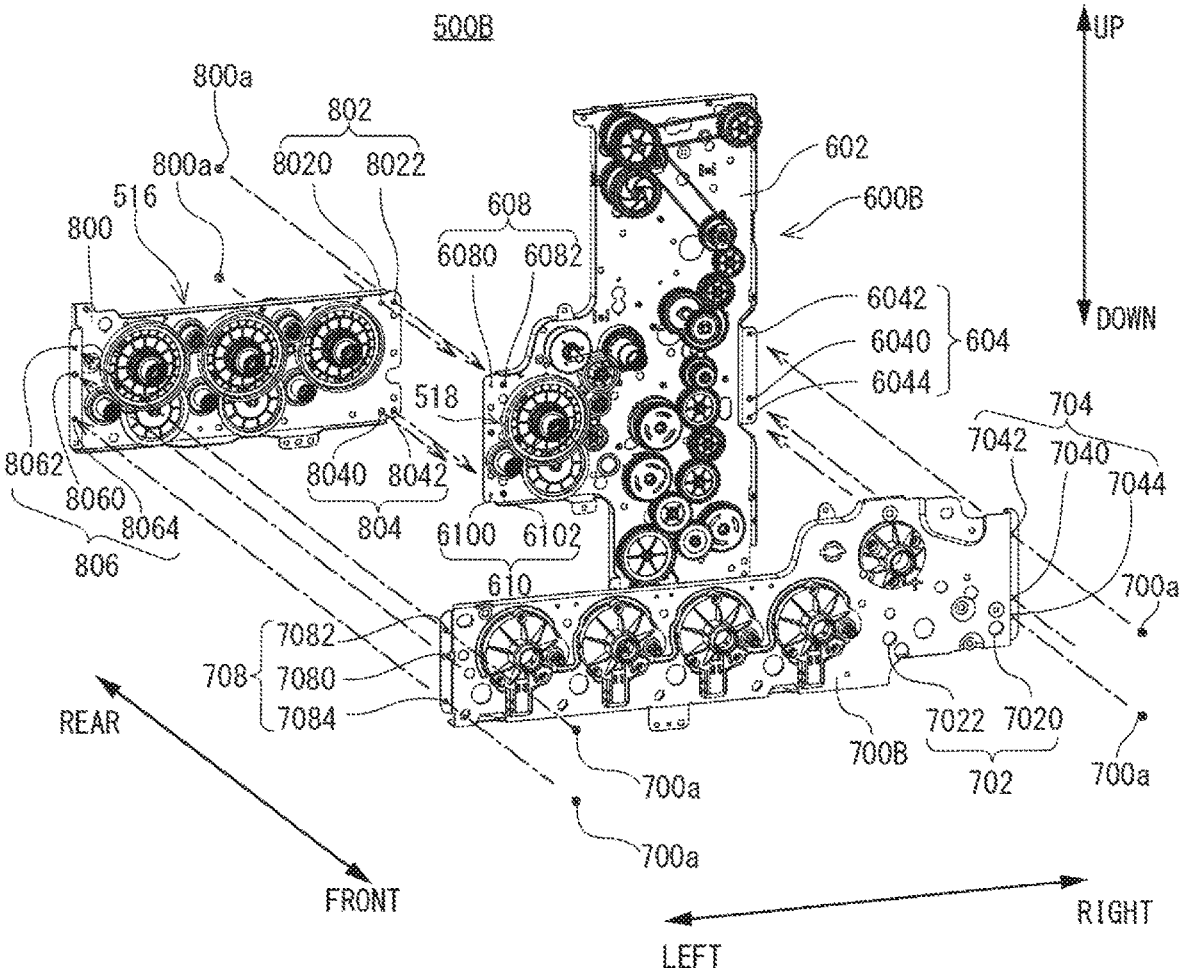
FIG. 27 is a schematic perspective view showing the structure of the driving unit for color when partially disassembled.

As shown in FIG. 25-FIG. 27, the driving unit for color 500B includes a first drive source 502, a second drive source 504, a third drive source 506, a feed driving mechanism 510, a fixing driving mechanism 514, a second process driving mechanism 516, a third process driving mechanism 518 and a drive frame for color 600B. The driving unit for color 500B is attached to the rear end portion (rear surface) of the resin frame 90.

The second process driving mechanism 516 is a mechanism for transmitting a rotational driving force from the second drive source 504 to rotating bodied included in the image stations of cyan (C), magenta (M) and yellow (Y) out of various rotating bodies included in the image forming portion for color 30B.

The third process driving mechanism 518 is a mechanism for transmitting a rotational driving force from the third drive source 506 to rotating bodied included in the image station of black (B) and the intermediate transfer belt unit 70 (drive rollers) out of various rotating bodies included in the image forming portion for color 30B.

That is, the rotational driving force of the second drive source 504 is transmitted to the rotating bodies included in the image stations of cyan (C), magenta (M) and yellow (Y), and the rotational driving force of the third drive source 506 is transmitted to the rotating bodies included in the image station of black (B) and the drive rollers. Moreover, in the third embodiment, a rotational driving force of the first drive source 502 is transmitted only to the feed driving mechanism 510 and the fixing driving mechanism 514.

Next, structure of the drive frame for color 600B will be described. The drive frame for color 600B includes a first support frame 602, a positioning frame for color 700B and a second support frame 800. In addition, as for the drive frame for color 600B, it is possible to use the same first support frame 602 included in the drive frame for monochrome 600A (the same as the drive frame 600 in the first embodiment).

However, in the third embodiment, the first support frame 602 supports the first drive source 502, the third drive source 506, the feed driving mechanism 510, the third process driving mechanism 518 and the fixing driving mechanism 514.

Moreover, although description is omitted in the first embodiment, as shown in FIG. 27, the first support frame 602 includes a third positioning/securing portion 608 and a fourth positioning/securing portion 610. However, the third positioning/securing portion 608 and the fourth positioning/securing portion 610 are provided outside the third process driving mechanism 518 and the fixing driving mechanism 514 in the left-right direction in a side (left end portion) opposite to the first positioning/securing portion 604.

The third positioning/securing portion 608 includes a fitting protruding portion 6080 protruded rearwardly and a threaded hole 6082 into which a second support frame securing screw 800*a* is secured. Moreover, the fourth positioning/securing portion 610 includes a fitting protruding portion 6100 protruded rearwardly and a threaded hole 6102 into which the second support frame securing screw 800*a* is secured.

As shown in FIG. 26 and FIG. 27, the positioning frame for color 700B is formed so as to be extended in the left-right direction, and further includes a third positioning/securing portion 708 in addition to the conveyance frame engaging portion 702 and the first positioning/securing portion 704 described in the first embodiment. In addition, the second positioning/securing portion 706 that is described in the first embodiment is not included in the positioning frame for color 700B. Moreover, the positioning frame for color 700B is attached to the rear surface of the resin frame 90 (conveyance frame 100).

The third positioning/securing portion 708 is provided in a side (left end portion) opposite to the first positioning/securing portion 704 in left-right direction. The third positioning/securing portion 708 includes a fitting hole 7080 corresponding to a fitting protruding portion 8060 described later and fastening holes 7082 and 7084 formed in positions corresponding to two threaded holes 8062 and 8064.

As shown in FIG. 26 and FIG. 27, the second support frame 800 is attachably and detachably attached to the rear side of the first support frame 602. That is, the positioning frame for color 700B and the second support frame 800 are provided so as to sandwich the first support frame 602 from the front and the rear. Moreover, the second support frame 800 supports the second drive source 504 and the second process driving mechanism 516.

Furthermore, the second support frame 800 includes a first positioning/securing portion 802, a second positioning/securing portion 804 and a third positioning/securing portion 806.

However, the first positioning/securing portion 802 and the second positioning/securing portion 804 are provided in one end (right end portion, in this embodiment) of the second support frame 800 in a longitudinal direction of the positioning frame for color 700B. Moreover, the third positioning/securing portion 806 is provided in another end portion (left end portion, in this embodiment) of the second support frame 800 in the left-right direction. Furthermore, the first positioning/securing portion 802 is provided in one end portion (upper end portion, in this embodiment) of the second support frame 800 in the up-down direction, and the second positioning/securing portion 804 is provided in another end portion (lower end portion, in this embodiment) of the second support frame 800 in the up-down direction.

The first positioning/securing portion 802 is provided in a position corresponding to the third positioning/securing portion 608 of the first support frame 605, and includes a fitting hole 8020 corresponding to the fitting protruding portion 6080 of the third positioning/securing portion 608 and a fastening hole 8022 formed in a position corresponding to the threaded hole 6082 of the third positioning/securing portion 608.

The second positioning/securing portion 804 is provided in a position corresponding to the fourth positioning/securing portion 610 of the first support frame 602, and includes a fitting hole 8040 corresponding to a fitting protruding portion 6100 of the four positioning/securing portion 610 and a fastening hole 8042 formed in a position corresponding to the threaded hole 6102 of the four positioning/securing portion 610.

Then, when the fitting protruding portion 6080 is fit into the fitting hole 8020 and the fitting protruding portion 6100 is fit into the fitting hole 8040, the position of the second support frame 800 with respect to the first support frame 602 is settled. Moreover, the second support frame 800 is attached to the first support frame 602 when the second support frame securing screw 800*a* for the second support frame is secured into the threaded holes 6082 and 6102 via the fastening holes 8022 and 8042.

The third positioning/securing portion 806 is provided in a position corresponding to the third positioning/securing portion 708 of the positioning frame for color 700B, and includes a fitting protruding portion 8060 corresponding to the fitting hole 7080 of the third positioning/securing portion 708 of the third positioning/securing portion 708 to be protruded forwardly and threaded holes 8062 and 8064 formed in positions corresponding to the fastening holes 7082 and 7084 of the third positioning/securing portion 708.

Then, when the fitting protruding portion 8060 is fit into the fitting hole 7080, the position of the second support frame 800 with respect to the positioning frame for color 700B is settled. Moreover, the second support frame 800 is attached to the positioning frame for color 700B when the frame securing screw 700*a* is secured to the threaded holes 8062 and 8064 via the fastening holes 7082 and 7084.

As described above, the drive frame for color 600B is constructed when the first support frame 602, the positioning frame for color 700B and the second support frame 800 are attached to each other.

As described above, the drive frame for monochrome 600A and the drive frame for color 600B can use commonly the same first support frame 602. Then, by attaching to the first support frame 602 alternatively the positioning frame for monochrome 700A or the positioning frame for color 700B and the second support frame 800, the specification of the driving unit 500 can be changed. This is because the first support frame 602 is formed with attaching holes according to the specifications.

Figure 28A:
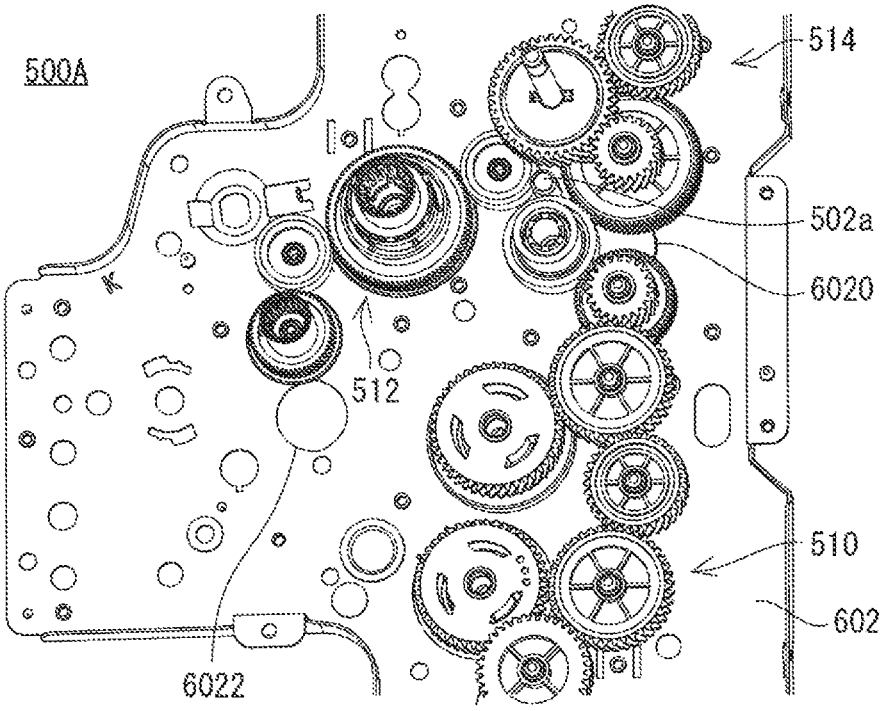
FIG. 28A is a schematic perspective view showing gear attaching structure with respect to a first support frame according to specifications.
Figure 28B:
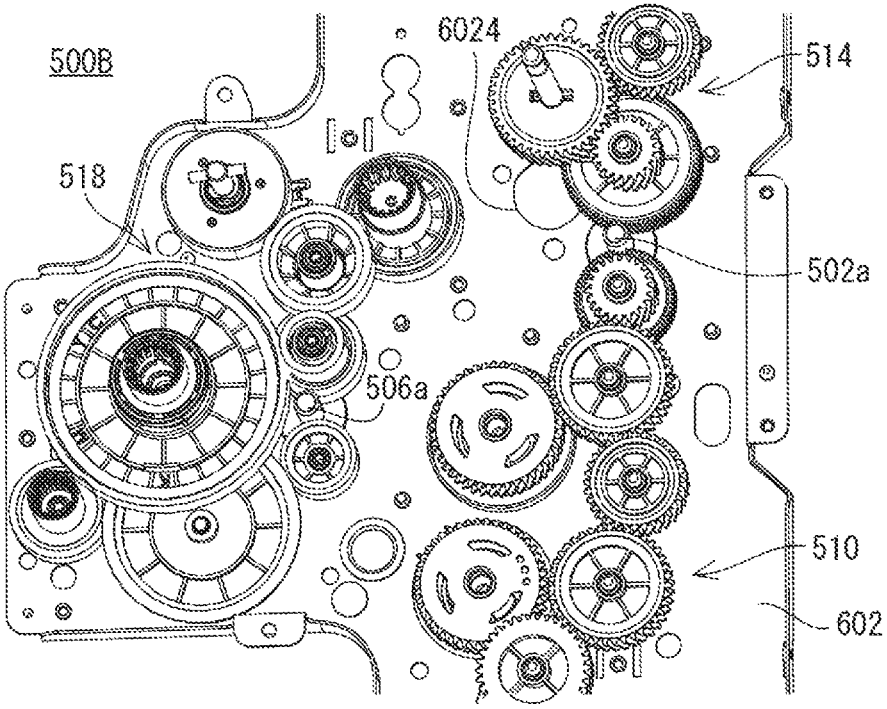
FIG. 28B is a schematic perspective view showing the gear attaching structure while omitting a third process driving mechanism.
Figure 29A:
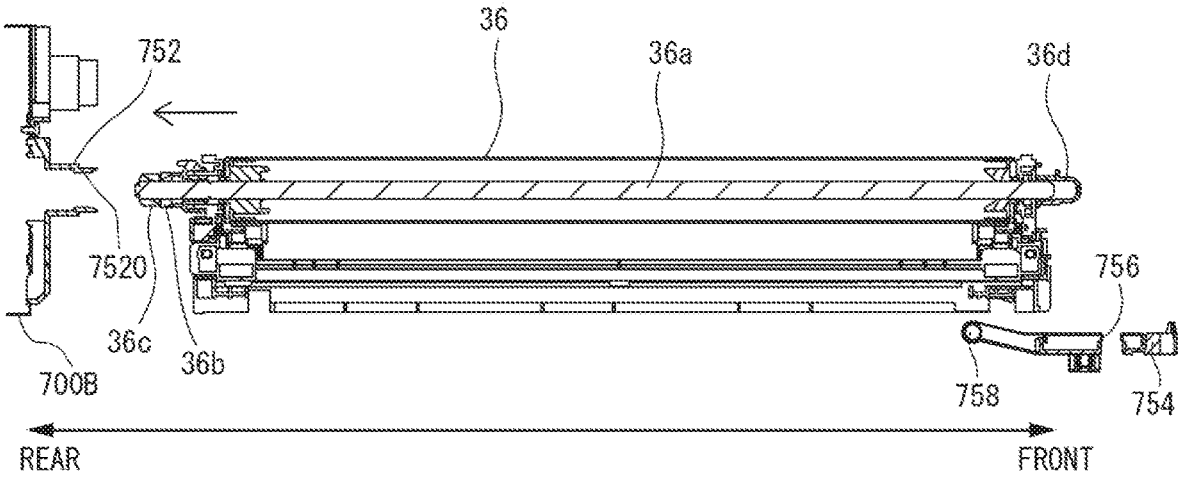
FIG. 29A is a schematic sectional view showing positioning structure of a process unit in the third embodiment before attaching of the process unit.
Figure 29B:
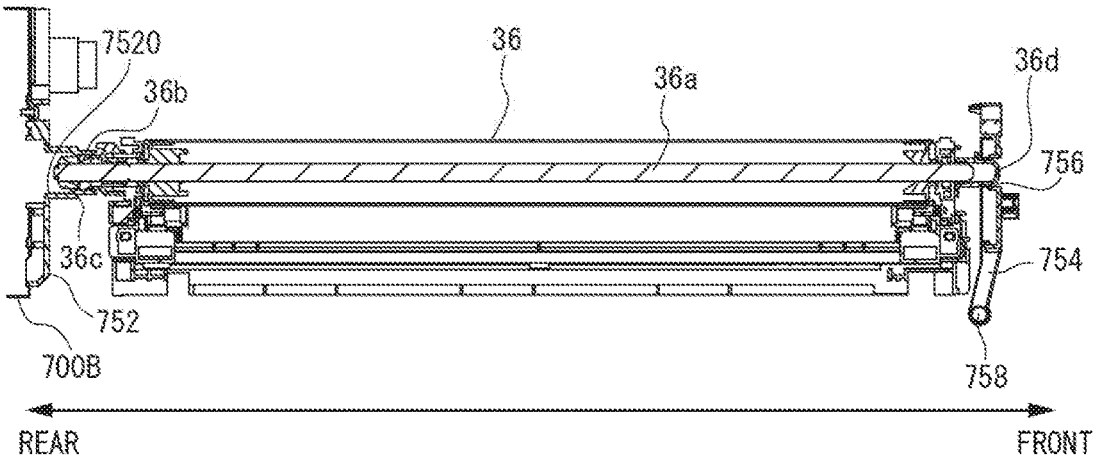
FIG. 29B is a schematic sectional view showing the positioning structure of a process unit in the third embodiment after attaching of the process unit.

As shown in FIG. 28A and FIG. 28B, a first attaching hole 6020, a second attaching hole 6022 and a third attaching hole 6024 are formed in the first support frame 602. For example, in the driving unit for monochrome 500A, the first drive source 502 is attached to the third attaching hole 6024, but the first attaching hole 6020 and the second attaching hole 6022 are not used. On the other hand, in the driving unit for color 500B, the first drive source 502 is attached to the first attaching hole 6020, and the third drive source 506 is attached to the second attaching hole 6022, but the third attaching hole 6024 is not used.

Thus, the first support frame 602 is formed with the motor attaching holes in advance according to the assumed specifications. Moreover, although detailed description is omitted, according to the assumed specification of the image forming apparatus 10, not only the motor attaching holes but also attaching holes and work holes for attaching axes (rotation bearing axes) such as pulleys and gears are formed in the first support frame 602 in advance.

Next, with reference to FIG. 26, FIG. 29A, FIG. 29B and FIG. 30, positioning structure of respective photoreceptor drums 36 and positioning structure of the intermediate transfer belt unit 70 in the image forming portion for color 30B will be described.

As shown in FIG. 26, a bearing guide member for transfer unit 750 and bearing guide members for photoreceptor drum 752 that are respectively formed with resin material are attached to the front surface of the positioning frame for color 700B. The bearing guide member for transfer unit 750 is provided on the front of transfer unit drive gears (driving gears for transfer units) included in the third process driving mechanism 518. The bearing guide members for photoreceptor drum 752 include four bearing guide members 752Y, 752M, 752C and 752K corresponding to the image stations for respective colors. Each of the bearing guide members 752Y, 752M, 752C and 752K is provided on the front of photoreceptor drum drive gears (driving gears for photoreceptor drums) for respective colors.

Moreover, the bearing guide member for transfer unit 750 is formed coaxially with a center axis of the transfer unit drive gear, and includes a bearing guide portion 7500 protruded forwardly in a substantially cylindrical shape. Each of the bearing guide members for photoreceptor drum 752 is formed coaxially with each of center axes of the photoreceptor drum drive gears, and includes a bearing guide portion 7520 protruded forwardly in a substantially cylindrical shape.

Figure 30:
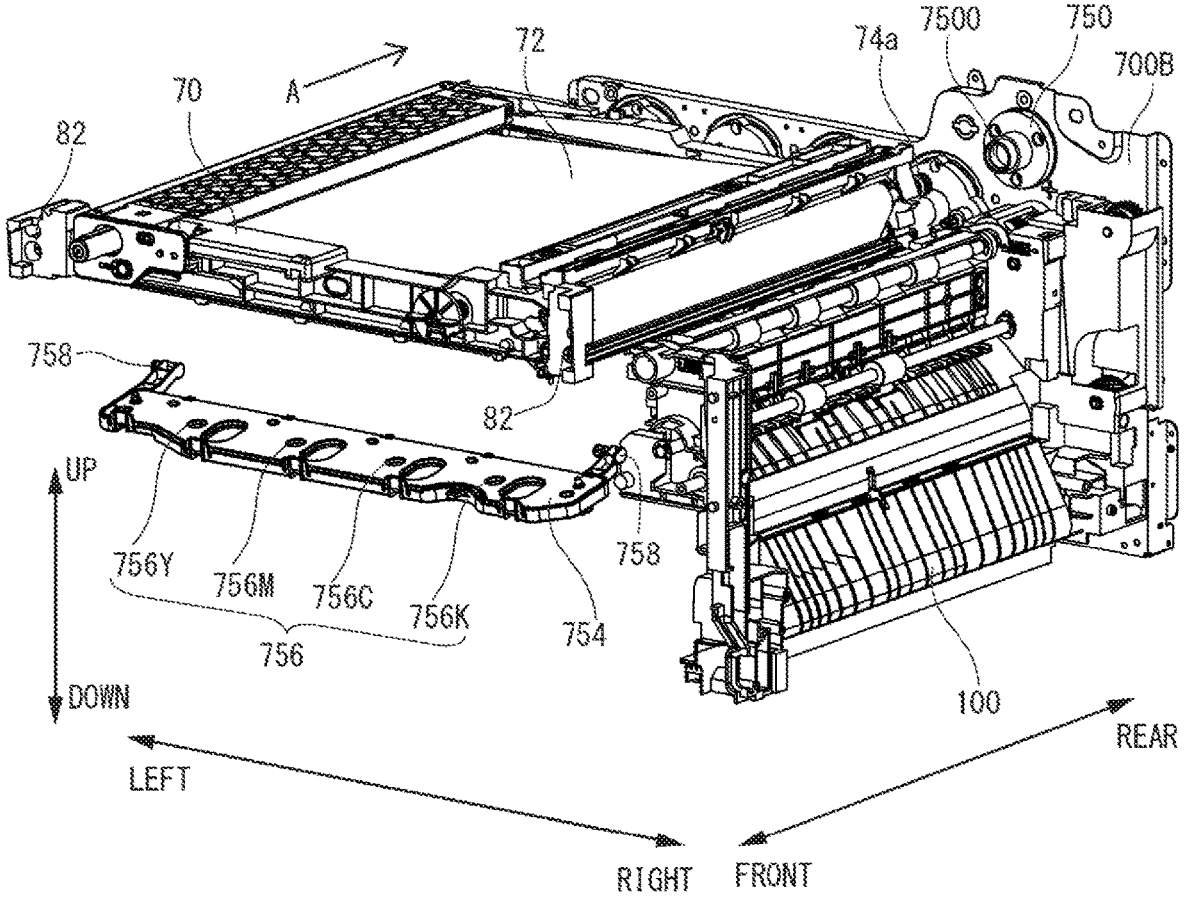
FIG. 30 is a schematic perspective view showing attaching structure of an intermediate transfer belt unit.

Then, as shown in FIG. 30, when the bearing 74*a* in the rear side of the drive roller 74 of the intermediate transcribe belt unit 70 is fit into the bearing guide portion 7500 of the transfer unit bearing guide member 750, the position of the rear end portion of the intermediate transfer belt unit 70 is settled with being centered by the driving axis of the drive roller 74. An arrow mark A in FIG. 30 is an attaching direction of the intermediate transfer belt unit 70.

Moreover, a positioning portion 82 with respect to the positioning frame for color 700B is provided in the front end portion of the intermediate transfer belt unit 70. This positioning portion 82 is provided in each of both ends of the intermediate transfer belt unit 70 in the left-right direction. The positioning portion 82 is a combination of a fitting projection and the fitting hole, for example, one of the fitting projection and the fitting hole is provided in the front end portion of the intermediate transfer belt unit 70, and the other is provided in the positioning frame for color 700B. The position of the front end portion of the intermediate transfer belt unit 70 is settled by this positioning portion 82.

As shown in FIG. 29, when the bearing of the photoreceptor drum 36 included in each of the image stations is fit into the bearing guide portion 7520 of the photoreceptor bearing guide member 752, the position of the rear end portion of each photoreceptor drum 36 is settled with being centered by the driving axis of the photoreceptor drum 36.

Moreover, as shown in FIG. 29 and FIG. 30, a front side positioning member 754 is provided in front of each of the photoreceptor drums 36. The front side positioning member 754 includes a plurality of positioning portions 756 respectively corresponding to the photoreceptor drums 36 included in the image stations, and turning axis portions 758.

The turning axis portions 758 support both end portions of the front side positioning member 754 in the left-right direction so as to be turnable with being centered by the rotation axis that is extended in the left-right direction. In addition, both of the turning axis portions 758 may be attached to the process frame for color 200B, or one of the turning axis portions 758 may be attached to the process frame for color 200B, and the other may be attached to the conveyance frame 100.

The plurality of positioning portions 756 are through holes formed in positions corresponding to axis covers 36*d* provided in the front end portion of the driving axis 36*a* of each photoreceptor drum 36. When the axis covers 36*d* of photoreceptor drums 36 are fit into the positioning portions 756, the position of the front end portion of the photoreceptor drum 36 (image station) of each color is settled. That is, intervals between the photoreceptor drums 36 included in the image stations of the respective colors are settled (controlled).

According to the third embodiment constructed as described above, since both of the driving unit for monochrome 500A and the driving unit for color 500B each having the driving mechanism include the positioning frames 700 attached to one surface (rear surface) of the resin frame 90 (resin frame body), it is possible to improve workability at the time of attaching the driving unit to the resin frame.

That is, the workability of attaching the sheet metal member supporting the driving mechanism constituting each driving unit to the resin frame 90 can be improved.

Then, because of having the positioning portions 710, 750 and 752 by which the process unit 68 is positioned, the positioning frame 700 can improve the attaching workability of the sheet metal member that supports the driving mechanism capable of reliably transmitting the drive force to the rotating body while supporting with high precision the rotating body with respect to the resin frame 90.

Moreover, according to the third embodiment, the process frames 200 having different specifications and the driving units 500 having different specifications can be provided selectively according to the specification of the image forming apparatus 10, and therefore, it is possible to change the specification of the apparatus easily. Specifically, the conveyance frame 100 and the fixation frame 300 can be used irrespective of the specification, and therefore, the specification of the resin frame 90 can be changed by changing only the process frame 200. Moreover, the first support frame 602 provided on the driving unit 500 can be used irrespective of the specification, and therefore, it is possible to change the specification of the drive frame 600 i. e., the driving unit 500 by changing only the positioning frame 700 that is attached to the first support frame 602. In other words, the workability of attaching the sheet metal member supporting the driving mechanism according to the specifications of the resin frame body (frame) to the resin frame body (frame) can be improved. Especially, even if the specification of the resin frame body (frame) is changed, it is possible to attach the sheet metal member that supports the rotating body with high precision and supports the driving mechanism capable of reliably transmitting the rotational driving force to the rotating body with good workability.

In addition, although the image forming apparatus is constituted as a multifunction peripheral (MFP) in each of the above-described embodiments, an image forming apparatus that the present invention is applicable may be a printer, a copying machine or a facsimile.

It should be noted that the specific shapes or forms referred to in the above-described embodiments are all mere examples, and to be changed appropriately in accordance with the actual products.

Although the present invention has been described and illustrated in detail, it is clearly understood that the same is by way of illustration and example only and is not to be taken by way of limitation, the spirit and scope of the present invention being limited only by the terms of the appended claims. Furthermore, it is intended that the scope of the present invention covers all modifications within the meaning and range of equivalency of the claims.

What is claimed is:

1. An image forming apparatus having a sheet feeding path, comprising:

a first resin frame made of resin;

a second resin frame made of resin, the second resin frame being provided in a downstream side in a sheet feeding direction compared with the first resin frame;

rotating bodies, at least one being attached to the first resin frame and at least one being attached to the second resin frame;

a driving unit including a driving mechanism that applies a rotational driving force to each of the rotating bodies; and a positioning portion having a support portion and an attaching portion of the driving unit, the support portion being positioned with respect to one of the first resin frame and the second resin frame, and supporting the rotating body attached to another of the first resin frame and the second resin frame, wherein the positioning portion is attached to a surface of one of the first resin frame and the second resin frame.

2. The image forming apparatus according to the claim 1, wherein the positioning portion is provided attachably and detachably to the driving unit.

3. The image forming apparatus according to the claim 1, wherein the driving mechanism includes a first driving mechanism and a second driving mechanism, the driving unit includes a first driving unit including the first driving mechanism and a second driving unit including the first driving mechanism and the second driving mechanism, the first driving mechanism includes at least one drive source, and rotationally drives a first type of rotating body out of the rotating bodies, the second driving mechanism includes a plurality of drive sources, and rotationally drives the first type of rotating body and a second type of rotating body out of the rotating bodies, and the positioning portion comprises selectively one of a first type positioning frame attached to the first driving unit and a second type positioning frame attached to the second driving unit.

4. The image forming apparatus according to the claim 3, wherein the driving unit includes a third driving mechanism that includes at least one drive source, and drives rotationally a third type rotating body out of the rotating bodies, the second driving unit includes a first support frame that supports the first driving mechanism and the third driving mechanism, and a second support frame that supports the second driving mechanism, and the first support frame and the second support frame are positioned and secured to one of the first type positioning frame and the second type positioning frame in parallel with each other.

5. The image forming apparatus according to the claim 4, further comprising a positioning/securing portion that secures the first support frame and the second support frame into a predetermined positional relationship.

6. The image forming apparatus according to the claim 3, wherein the driving unit includes a third driving mechanism that includes at least one drive source, and drives rotationally a third type rotating body out of the rotating bodies, and the first driving unit includes the third driving mechanism.

7. The image forming apparatus according to the claim 3, wherein the first driving mechanism includes a plurality of drive sources each of which drives rotationally the first type rotating body corresponding thereto.

8. The image forming apparatus according to the claim 3, wherein the first driving mechanism includes a feed driving mechanism that drives rotationally the rotating body arranged along the sheet feeding path out of the rotating bodies.

9. The image forming apparatus according to the claim 1, wherein the driving unit includes a securing portion for securing the driving unit to the first resin frame and the second resin frame.

10. A frame body of an image forming apparatus that comprises a sheet feeding portion including a sheet stop roller that controls a feeding timing of a sheet and an image forming portion that forms an image on the sheet fed by the sheet feeding portion, comprising:

a conveyance frame made of resin, the conveyance frame supporting the sheet feeding portion;

a process frame made of resin, the process frame being attached to the conveyance frame in a downstream side in a sheet feeding direction, and supporting the image forming portion; and a positioning portion that positions the process frame with respect to the conveyance frame with a driving axis of the sheet stop roller as a reference.

11. The frame body according to the claim 10, wherein the positioning portion includes a first engaging portion provided on the conveyance frame and formed with being centered by the driving axis of the sheet stop roller, and a second engaging portion provided on the process frame, and engages with the first engaging portion.

12. The frame body according to the claim 11, wherein the conveyance frame includes a bearing portion that bears the driving axis of the sheet stop roller, and the first engaging portion has a circular arc-shaped first engaging surface formed coaxially with the bearing portion, and the second engaging portion has a second engaging surface that engages with the first engaging surface.

13. The frame body according to the claim 10, wherein said positioning portion is a first positioning portion, and the image forming apparatus further comprises a fixing portion provided in a downstream side in the sheet feeding direction compared with the image forming portion to fix an image formed on the sheet with heating, and a discharge portion provided in a downstream side in sheet feeding direction compared with the fixing portion to discharge the sheet outside the apparatus, further comprising:

a fixation frame made of resin, the fixation frame being attached to the conveyance frame in a downstream side in the sheet feeding direction, and supporting the fixing portion and the discharge portion; and a second positioning portion that positions the fixation frame with respect to the conveyance frame.

14. The frame body according to the claim 13, wherein the conveyance frame, the process frame and the fixation frame are made of resins different from each other.

15. The frame body according to the claim 13, wherein the second positioning portion further comprises a metallic coupling member secured to the conveyance frame of the fixation frame for positioning the fixation frame with respect to the conveyance frame.

16. The frame member according to the claim 15, wherein the second positioning portion includes a first protruding portion provided on the conveyance frame, a second protruding portion provided on the fixation frame in a position away from the second protruding portion by a predetermined distance, a first fitting portion provided on the coupling member to be fit to the second protruding portion, and a second fitting portion provided on the coupling member to be fit to the third protruding portion.

17. The frame body according to the claim 15, wherein the image forming apparatus further comprises a sheet feeding portion and a driving mechanism that applies a rotational driving force to the sheet feeding portion and the image forming portion, and the coupling member is arranged in each of both outsides of a sheet feeding path that the sheet is fed, and one coupling member supports the driving mechanism.

18. The frame body according to the claim 17, wherein said driving mechanism is a first driving mechanism, and the image forming apparatus further comprises a second driving mechanism that transmits a rotational driving force to the fixing portion and the discharge portion, and the second driving mechanism is supported by the one coupling member.

19. The frame body according to the claim 17, further comprising a fastening portion for fastening the one coupling member and the conveyance frame with a predetermined securing tool.

20. The frame body according to the claim 13, wherein the process frame includes a guide portion that guides the fixing portion to a predetermined position prior to the fixation frame is secured to the conveyance frame.

21. The frame body according to the claim 10, wherein the conveyance frame is formed with a sheet guide portion that guides the sheet.

22. An image forming apparatus, comprising:

a conveyance frame made of resin, the conveyance frame supporting a sheet feeding portion that feeds a sheet;

a process frame made of resin, the process frame accommodating an image forming portion that forms an image onto the sheet; and a positioning portion that positions the image forming portion with respect to the conveyance frame, wherein the positioning portion includes a positioning engaging portion that is engaged with the conveyance frame, and an attachment positioning portion that supports the image forming portion and defines an attaching position of the image forming portion.

23. The image forming apparatus according to the claim 22, wherein the positioning portion includes a fitting protruding portion provided on the conveyance frame and a fitting hole formed on the positioning engaging portion to be fit with the fitting protruding portion.

24. The image forming apparatus according to the claim 22, wherein the sheet feeding portion includes a feed roller that feeds the sheet, the conveyance frame includes a drive supporting member that supports a feed driving mechanism that applies a rotational drive force to the feed roller, and the positioning engaging portion is attached to the conveyance frame via the drive supporting member.

25. The image forming apparatus according to the claim 24, wherein the drive supporting member includes a fitting hole to be fit with the fitting protruding portion provided on the conveyance frame.

26. The image forming apparatus according to the claim 22, wherein the positioning engaging portion is made of metal material, and the attachment positioning portion is made of resin material and attached to the positioning engaging portion.

27. The image forming apparatus according to the claim 22, wherein the conveyance frame is formed with a sheet guide portion that guides the sheet.

28. The image forming apparatus according to the claim 22, wherein the sheet feeding portion includes a sheet stop roller that controls a feeding timing of the sheet, and the positioning engaging portion includes a bearing fitting portion that is fit to a bearing supporting a rotation axis of the sheet stop roller.

29. The image forming apparatus according to the claim 22, wherein the image forming portion and the attachment positioning portion are respectively provided in a plural number.

* * * * *